US010427311B2

(12) United States Patent
Nguyen et al.

(10) Patent No.: US 10,427,311 B2
(45) Date of Patent: Oct. 1, 2019

(54) HANDHELD LIGHTING DEVICE WITH DETACHABLE KNIFE

(71) Applicant: SureFire, LLC, Fountain Valley, CA (US)

(72) Inventors: Loc Nguyen, Santa Ana, CA (US); John W. Matthews, Newport Beach, CA (US)

(73) Assignee: SureFire, LLC, Fountain Valley, CA (US)

( * ) Notice: Subject to any disclaimer, the term of this patent is extended or adjusted under 35 U.S.C. 154(b) by 0 days.

(21) Appl. No.: 15/870,605

(22) Filed: Jan. 12, 2018

(65) Prior Publication Data

US 2018/0194021 A1 Jul. 12, 2018

Related U.S. Application Data

(60) Provisional application No. 62/445,530, filed on Jan. 12, 2017.

(51) Int. Cl.

| | |
|---|---|
| ***B25B 23/18*** | (2006.01) |
| ***B26B 11/00*** | (2006.01) |
| ***B26B 5/00*** | (2006.01) |
| ***B26B 1/08*** | (2006.01) |

(52) U.S. Cl.
CPC ..... *B26B 11/008* (2013.01); *B26B 1/08* (2013.01); *B26B 5/001* (2013.01)

(58) Field of Classification Search
CPC .. B26B 1/08; B26B 5/00; B26B 5/001; B26B 5/003; B26B 11/00; B26B 11/006; B26B 11/008
USPC ..... 362/119–120
See application file for complete search history.

(56) References Cited

U.S. PATENT DOCUMENTS

| | | | | |
|---|---|---|---|---|
| 4,751,621 | A | 6/1988 | Jenkins | |
| 5,442,529 | A | 8/1995 | Hoover | |
| 6,511,199 | B1 * | 1/2003 | Chung | B25B 23/18 362/119 |
| D488,205 | S | 4/2004 | Skowronski | |

(Continued)

OTHER PUBLICATIONS

"Pocket Knife with LED Light—#1 Rated for Hunting & Outdoors", Under Control Tactical, Sep. 19, 2016, 2 pages [online], [retrieved on Apr. 13, 2017]. Retrieved from the Internet: <URL:https://www.undercontroltactical.com/products/knife-with-led-light>.

(Continued)

*Primary Examiner* — Jason M Han
(74) *Attorney, Agent, or Firm* — Haynes and Boone, LLP

(57) ABSTRACT

A handheld lighting device is provided with a detachable knife assembly. In one example, the handheld lighting device may include a light source that generates a light beam to illuminate a scene, such as a work area. The knife assembly may be coupled to the lighting device using an attachment mechanism. The lighting device may include a slot that may receive a sleeve of the knife assembly such that the knife assembly may be secured to the lighting device. The lighting device may illuminate the work area such that a user may readily see the area that a knife of the knife assembly may cut. The light source of the lighting device may be activated using a multi-access user control that may be L-shaped and actuated from one or more locations on the user control. Additional features and related methods are also provided.

22 Claims, 20 Drawing Sheets

(56) References Cited

U.S. PATENT DOCUMENTS

| | | | | |
|---|---|---|---|---|
| 6,890,135 | B2 * | 5/2005 | Kopras | B25F 5/02 144/136.95 |
| 7,008,076 | B2 | 3/2006 | Zirk et al. | |
| 7,226,181 | B2 * | 6/2007 | Galli | B26B 11/008 362/109 |
| D549,799 | S | 8/2007 | Kroll | |
| D553,276 | S | 10/2007 | Campbell et al. | |
| D557,841 | S | 12/2007 | Lee | |
| D598,593 | S | 8/2009 | Kingston et al. | |
| D615,676 | S | 5/2010 | Lee | |
| D737,487 | S | 8/2015 | Beckett et al. | |
| 9,120,237 | B2 | 9/2015 | Staines | |
| D747,263 | S | 1/2016 | Lafferty | |
| D750,949 | S | 3/2016 | Hofman et al. | |
| D756,014 | S | 5/2016 | Bao | |
| D758,299 | S | 6/2016 | Lafferty | |
| D764,087 | S | 8/2016 | Workman et al. | |
| D767,183 | S | 9/2016 | Caito et al. | |
| D779,092 | S | 2/2017 | Xu et al. | |
| D803,440 | S | 11/2017 | Tompkin | |
| D805,666 | S | 12/2017 | Nguyen et al. | |
| D806,294 | S | 12/2017 | Nguyen et al. | |
| 2003/0112622 | A1 * | 6/2003 | Chu | A01K 97/18 362/109 |
| 2006/0241664 | A1 * | 10/2006 | Lam | A61B 17/3211 606/167 |

OTHER PUBLICATIONS

"Knives", Rapid Tools, Nov. 7, 2016, 6 pages [online], [retrieved on Apr. 13, 2017]. Retrieved from the Internet:<URL:http://www.rapidtools.net/Serrated-Knives.html>.

"Rapid Tools RT00001 Rapid Edge Utility Knife with LED Light for Close-Quarters", amazon, Nov. 11, 2012, 6 pages [online], [retrieved on Apr. 13, 2017]. Retrieved from the Internet: <URL:https://www.amazon.com/Rapid-Tools-RT00001-Utility-Close-Quarters/dp/B000HBS5C2>.

"Coast LK375 Light Knife", amazon, May 31, 2016, 6 pages [online], [retrieved on Apr. 13, 2017]. Retrieved from the Internet: <URL:https://www.amazon com/Coast-LK375-Light-Knife/dp/B00UP3TOD6>.

"Brite-Blade™ Tactical Lighted Survival Knife", Brite Strike Tactical Illumination Products, Nov. 15, 2016, 5 pages [online], [retrieved on Apr. 13, 2017]. Retrieved from the Internet: <URL: http://www.brite-strike.com/brite-blade.html>.

"SlimCut Brite", GatorBlade, Oct. 27, 2016, 1 page [online], [retrieved on Apr. 13, 2017]. Retrieved from the Internet: <URL: http://slimcut.net/led/knife>.

"Knives", Tool Logic Built for Life, Nov. 4, 2016, 2 pages [online], [retrieved on Apr. 13, 2017]. Retrieved from the Internet: URL:http://www.toollogic.com/knives.html>.

"Bladelight Folding Mini, Satin", SOG, Sep. 29, 2016, 4 pages [online], [retrieved on Apr. 13, 2017]. Retrieved from the Internet: <URL:https://www.sogknives.com/bladelight-folding-mini-satin.html>.

"Tac-Force Knives LED Light Assisted Opening Rescue Knife", amazon, Dec. 1, 2016, 6 pages [online], [retrieved on Apr. 14, 2017]. Retrieved from the Internet: <URL:https://www.amazon.com/TAC-FORCE-KNIVES-Assisted-Opening-Rescue/dp/B014D4C5HY>.

U.S. Appl. No. 29/590,692, filed Jan. 12, 2017, inventors: Nguyen et al., 11 pages.

* cited by examiner

HANDHELD LIGHTING DEVICE WITH DETACHABLE KNIFE

CROSS-REFERENCE TO RELATED APPLICATIONS

This application claims priority to and the benefit of U.S. Provisional Patent Application No. 62/445,530 filed Jan. 12, 2017 and entitled "HANDHELD LIGHTING DEVICE WITH DETACHABLE KNIFE" which is hereby incorporated by reference in its entirety.

TECHNICAL FIELD

The invention relates to utility devices and, more specifically, to handheld lighting devices with utility functionality.

BACKGROUND

A user may need sufficient light on a work area during certain tasks requiring cutting, for example, tactical situations or outdoor activities such as camping, fishing, hunting, or daily chores. Illumination of the work area is essential for the user to use a knife accurately and safely, thus often requiring artificial lighting, such as a flashlight, if natural light is insufficient, such as a shadowed area, or nonexistent, such as at night.

However, handling a flashlight simultaneous to using a knife may be cumbersome, inefficient, and unsafe. For example, a camper may require a knife to shave tinder used to build a fire at night. The user must hold a branch to strip bark from the branch with the knife. This task makes it impossible for the user to hold a flashlight to properly illuminate the branch such that the user may see the work area and shave the tinder from the branch. Therefore, the user must set the flashlight down, which would result in poor illumination of the work area. Accordingly, conventional lighting devices fail to address the needs of certain real word conditions experienced by users.

SUMMARY

In accordance with various embodiments further discussed herein, a lighting device with a detachable knife assembly and methods of operation of the lighting device and knife assembly are provided to generate a light beam that intersects with a blade of the knife assembly.

In one embodiment, a lighting device may include: a housing configured to be gripped by a user; a light source disposed at least partially within the housing and configured to project a light beam to illuminate an area of interest external to the housing; and a knife assembly having a sleeve and a knife at least partially enclosed by the sleeve and coupled thereto. The knife assembly may be selectively decoupled from the housing to permit the user to selectively operate the lighting device with the knife assembly and without the knife assembly.

In another embodiment, a method may include: providing a lighting device that includes a housing configured to be gripped by a user, a light source disposed at least partially within the housing and configured to project a light beam to illuminate an area of interest external to the housing, and a knife assembly with a sleeve and a knife at least partially enclosed by the sleeve and coupled thereto; operating the light source while the knife assembly is coupled to the housing; decoupling the knife assembly from the housing; and operating the light source while the knife assembly is decoupled from the housing.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Embodiments of the present disclosure and their advantages are best understood by referring to the detailed description that follows. It should be appreciated that like reference numerals are used to identify like elements illustrated in one or more of the figures.

DETAILED DESCRIPTION

Figure 1:
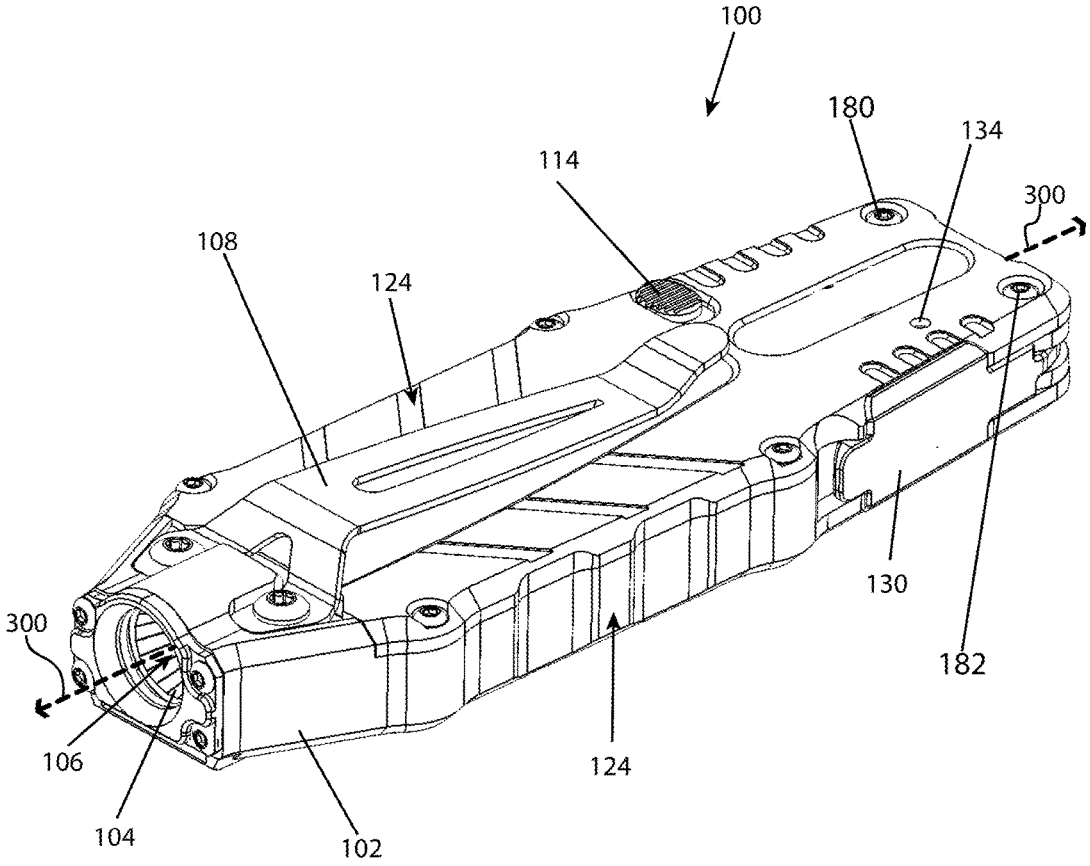
FIGS. 1-8 illustrate various views of a handheld lighting device in accordance with embodiments of the disclosure.

In accordance with various embodiments provided herein, a handheld lighting device (also referred to herein as a "lighting device") may be implemented with a selectively detachable knife assembly. In this regard, the knife assembly may be selectively decoupled from a housing to permit the user to selectively operate the lighting device with the knife assembly and without the knife assembly. For example, the knife assembly may be coupled and secured to the housing of the lighting device to provide a multipurpose handheld utility device that may illuminate an area of interest external to the housing (e.g., work area) that a knife of the knife assembly may be used to cut. Therefore, the knife assembly and lighting device may be used as separate components or coupled together. In certain embodiments, the handheld utility device may be particularly suited for use during various tasks in, for example, low-lighting environments requiring illumination.

Referring now to the drawings, wherein the showings are for purposes of illustrating embodiments of the present invention only and not for purposes of limiting the same, FIGS. 1-8 illustrate various views of a handheld lighting device 100, which may include a detachable knife assembly 200, in accordance with an embodiment of the disclosure.

FIG. 1 illustrates a perspective view of the lighting device in accordance with one or more embodiments of the disclosure. Lighting device 100 may include a housing 102 with a light source 106, which may project a light beam to illuminate an area of interest external to the housing, and a reflector 104 at least partially disposed within the housing. In one or more embodiments, housing 102 may provide grips 124 to permit a user to conveniently grip housing 102. For example, a user may use grip 124 to securely hold lighting device 100 when cutting a desired area using a coupled knife assembly 200 (shown in FIG. 2), thus preventing lighting device 100 from accidentally slipping out of the user's hand during use. In an embodiment, grip 124 may be implemented by indentations in surfaces of the housing 102, undulations of the surfaces of housing 102, and/or combinations thereof. Grip 124 may be made from the same material as the remainder of the housing 102 (e.g., grip 124 may be integrated and/or imprinted into housing 102) or may be a different material (e.g., a rubber insert). Housing 102 may also have a fastener 108 (e.g., belt clip) attached thereto to allow a user to secure lighting device 100 to the user's person.

Lighting device 100 may further include a USB port 128 (e.g., a micro USB port, shown in FIG. 9) covered by a removable USB cap 130 as discussed further herein. An indicator 134 (e.g., LED light) may be at least partially disposed in housing 102 to, for example, indicate when lighting device 100 is coupled (e.g., electrical coupling) to an external power source or other electronic device. In an embodiment, indicator 134 may generate a light of a single color, or produce various different colors depending on a current status of lighting device 100 (e.g., indicator 134 may produce light of a first wavelength when a battery is low or partially charged and a secondary wavelength when the battery is fully charge). Indicator 134 may also, for example, flash (e.g., blink), turn on, turn off, or increase or decrease in brightness to indicate various statuses of lighting device 100 determined by, for example, a controller of lighting device 100.

Figure 2:
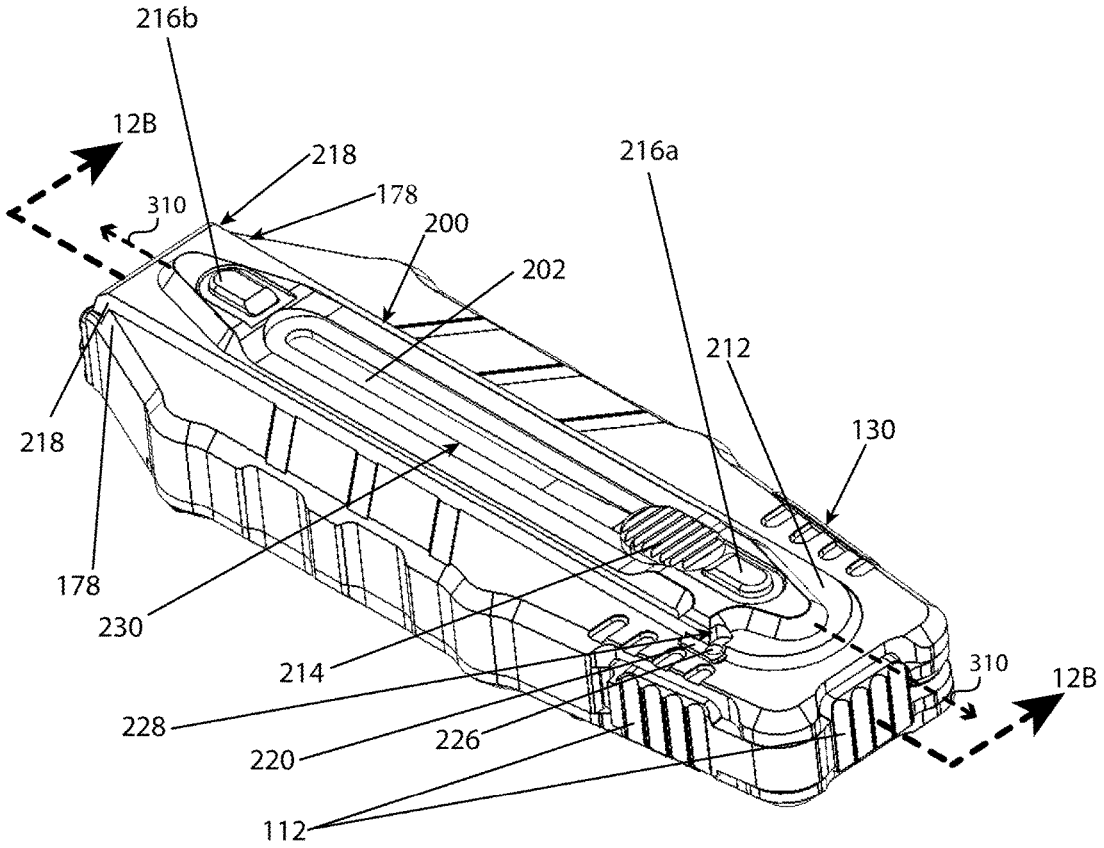

In one or more embodiments of the present disclosure, FIG. 2 shows lighting device 100 may provide a multi-access user control 112 (also referred to herein as a "user control") that may be an L-shaped button and may activate light source 106 of lighting device 100 in response to user actuations, and an adjustment mechanism 114 (e.g., a sliding switch) that may adjust a mode of operation of lighting device in relation to a light beam provided by light source 106 based on Hall effect principles (as shown in FIG. 1 and further discussed herein).

Figure 9:
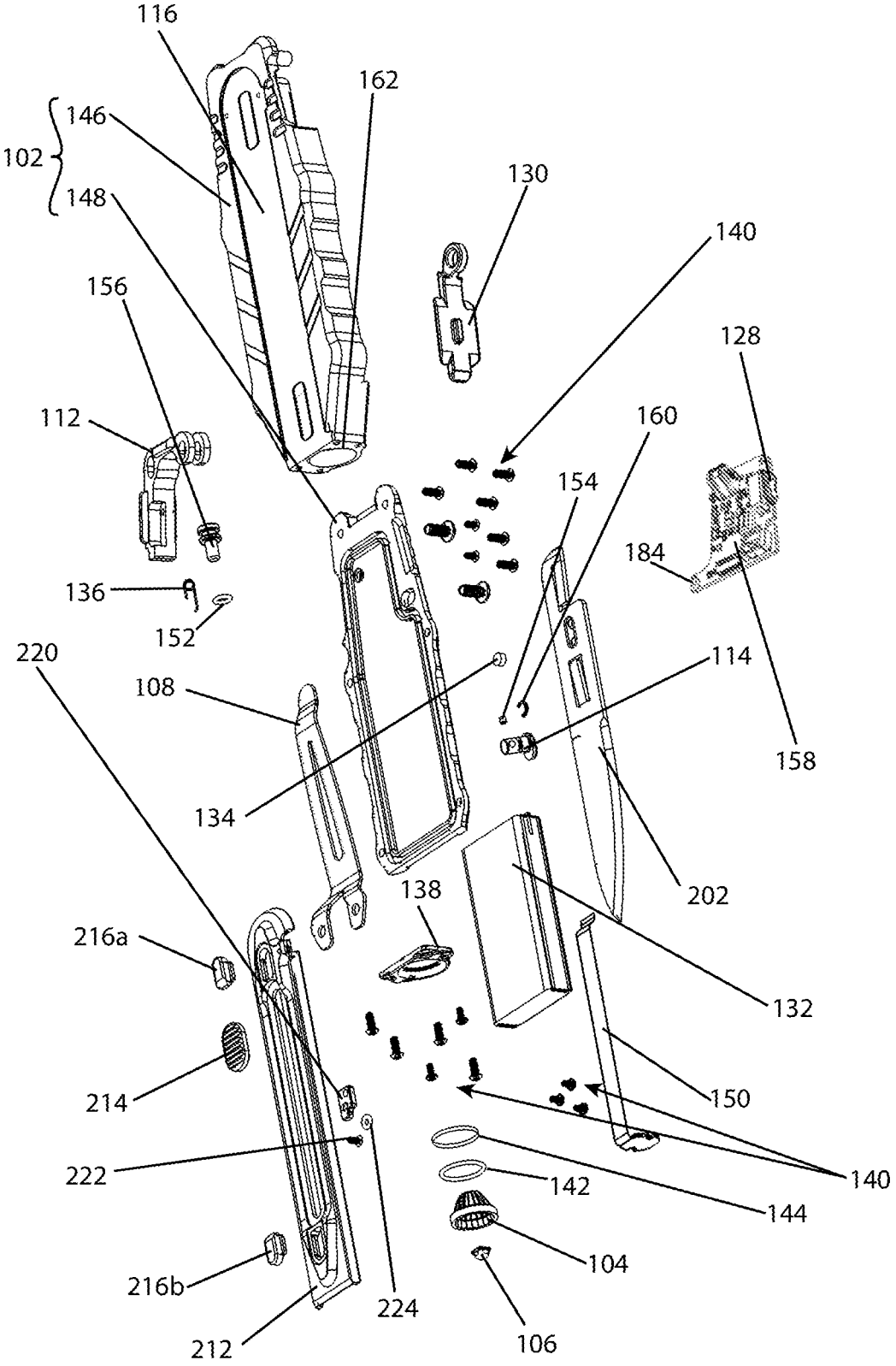
FIG. 9 illustrates an exploded view of a handheld lighting device in accordance with an embodiment of the disclosure.

Housing 102 may be a monolithic structure or have more than one component (e.g., a primary and a secondary housing, shown in FIG. 9). Housing 102 may provide coupling members 178 that may slidably receive complementary engagement members 218 of knife assembly 200 such that knife assembly 200 may be secured to lighting device 100 as discussed further herein. In one or more embodiments, knife assembly 200 may include a knife 202, a sleeve 212, sliding mechanism 214, safety mechanisms **216*a* and 216*b* (e.g., buttons), and locking member 220** (e.g., a securing panel).

In one or more embodiments, knife 202 may be at least partially enclosed by sleeve 212 and knife 202 may be coupled thereto. In another embodiment, sleeve 212 may completely enclose knife 202 such that a user may grip sleeve 212 to use knife assembly 200 separately from lighting device 100 if knife assembly 200 is detached from lighting device 100.

In an embodiment, use-operable sliding mechanism 214 may be attached to knife 202 using, for example, screws or a bonding agent (e.g., adhesive). Sliding mechanism 214 may translate (e.g., move fore and aft) within channel 230 (e.g., a mesial channel located along a longitudinal axis 310 of knife assembly 200), thus extending or retracting knife 202 in response to translation of sliding mechanism 214 relative to sleeve 212. For example, knife 202 may extend or retract in response to sliding mechanism moving fore or aft, respectively. In an embodiment, sliding mechanism 214 may be prevented from moving and extending a portion of knife 202 from sleeve 212 by safety mechanism **216*a*. In another embodiment, sliding mechanism 214 may be prevented from moving and retracting a portion of knife 202 into sleeve 212 by safety mechanism 216*b*** as discussed further herein.

FIGS. 3-8 illustrate various views of lighting device 100 with detachable knife 200 secured thereto in accordance with embodiments of the disclosure.

FIG. 9 shows an exploded view of handheld lighting device 100 in accordance with one or more embodiments of the present disclosure. Lighting device 100 may include: housing 102 which may include a primary housing 146, with a slot 116 (which may slidably receive engagement members 218 of knife assembly 200 as discussed further herein) and a front aperture 162, and a secondary housing 148; a front cover 138 of primary housing 146; fastener 108; light source 106; reflector 104; a lens 144; an o-ring 142; a circuit board 158 providing a USB port 128; USB cap 130; a connector 150 that allows circuit board 158 to communicate with light source 106; a Hall effect sensor 184 of circuit board 158; indicator 134; multi-access user control 112; a spring 136; an actuating pin 156 of multi-access user control 112; an o-ring 152 of actuating pin 156; adjustment mechanism 114 (e.g., sliding switch); a magnet 154 and a retaining ring 160 of adjustment mechanism 114; a power source 132 (e.g., a battery); sleeve 212; knife 202; safety mechanisms **216*a/b*; sliding switch 214; locking member 220; an o-ring 224 and screw 222 of locking member 220; and various screws 140 used to assembly and secure components of lighting device 100 and/or knife assembly 200**.

Figure 10:
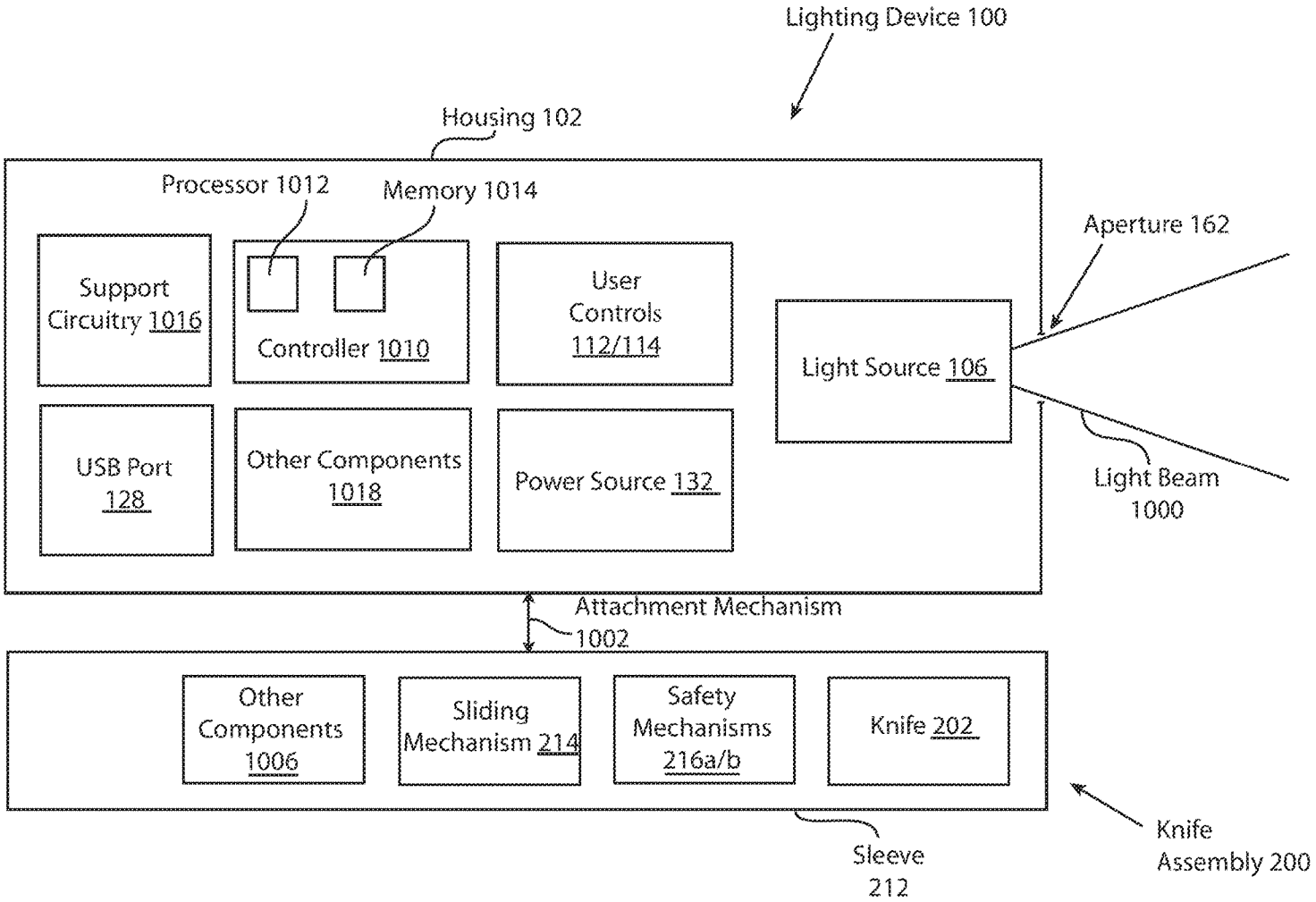
FIG. 10 illustrates a block diagram of a handheld lighting device in accordance with an embodiment of the disclosure.

FIG. 10 illustrates a block diagram of lighting device 100. Lighting device 100 may include housing 102 at least partially enclosing a controller 1010, support circuitry 1016 (e.g., implemented by appropriate components of circuit board 158), user controls 112/114, USB port 128, power source 132, a light source 106 that may provide a light beam 1000 through aperture 162 of housing 102, and other components 1018 (e.g., sensors such as, for example, the Hall effect sensor 184 that detects movement of magnet 154 in adjustment mechanism 114, a gyroscope, accelerometer, inclinometer, magnetometer, light sensor, and/or other sensors).

In one or more embodiments, controller 1010 may include a processor 1012 and a memory 1014. Processor 1012 may be implemented, for example, as a microcontroller, microprocessor, a Field Programmable Gate Array (FPGA), an Application Specific Integrated Circuit (ASIC), and/or any appropriate combination of these or other types of devices.

Memory 1014 (e.g., implemented as any appropriate type of volatile and/or non-volatile memory) may be used to store instructions and/or data. For example, in some embodiments, memory 1014 may be implemented as a non-transitory machine-readable medium storing various instructions which may be executed by processor 1012 to perform various operations such as receiving and processing operating instructions or sensor signals. In some embodiments, such a machine-readable medium may be provided within processor 1012 itself (e.g., as firmware and/or otherwise) and/or external to processor 1012. Processor 1012 may include processing circuitry disposed within housing 102 and may be configured to receive signals from user controls 112/114 or various other components.

In an embodiment, lighting device 100 may include light source 106. Light source 106 may be, for example, a light emitting diode (LED), an incandescent light bulb, a tungsten-halogen light bulb, a fluorescent light bulb, a high-intensity discharge light bulb, or any other singular or plural light source devices. Lighting device 100 may include one light source, two light sources, or more than two light sources. In an embodiment, light source 106 may generate light of various wavelengths (e.g., different colors of visible light such as red light, blue light, violent light, green light, or combinations thereof and/or invisible light, such as infrared light or ultraviolet). In another embodiment, lighting device 100 may provide a laser that may generate a laser beam (e.g., a laser aligned with knife 202 such that the laser beam may point at a place on a work surface that a user wishes to cut).

In various embodiments, light source 106 and/or the laser may react (e.g., turn on, turn off, flash, strobe, or increase or decrease in brightness level). For example, user controls 112/114 may turn light source on and off and/or increase or decrease the brightness of beam 1000, respectively. For example, in some embodiments, adjustment mechanism 114 may be a Hall effect user control that selects between different modes of operation associated with light beam 1000. In one or more embodiments, lighting device 100 may include one or more optical elements associated with each light source. For example, each light source may be disposed at least partially within a reflector (e.g., reflector 104) that shapes the light into a beam (e.g., light beam 1000) that is projected from lighting device 100 onto an area of interest (e.g., a work area such as an area that blade 204 of knife assembly 200 may be used on and may cut) external to housing 102. In an embodiment, light beam 1000 may be relatively aligned (e.g., parallel to longitudinal axis 310) and adjacent to extended blade 204 (as shown in FIG. 12C). In another embodiment, light beam 1000 may be angled relative to the length of blade 204.

USB port 128 of lighting device 100 may be used to provide an electrical coupling to an external device (e.g., an external power source, computer, or mobile device) to receive electrical power (e.g., the external power source may be used to charge power source 132) or communication signals (e.g., a wired communication) from the external device. Power source 132 (e.g., batteries, such as lithium ion, lithium manganese CR123A, or other battery) may be charged using USB port 128 and may provide power to lighting source 106.

Knife assembly 200 may include a knife 202 that is at least partially disposed in sleeve 212. Sleeve 212 may also at least partially enclose safety mechanisms 216*a*/*b*, sliding mechanism 214, and other components 1006.

Lighting device 100 and knife assembly 200 may interoperate to provide an attachment mechanism 1002 to secure (e.g., mechanically couple) knife assembly 200 to lighting device 100. In this regard, attachment mechanism 1002 may include coupling members 178 of lighting device 100 and engagement members 218 of knife assembly 200.

Figure 11:
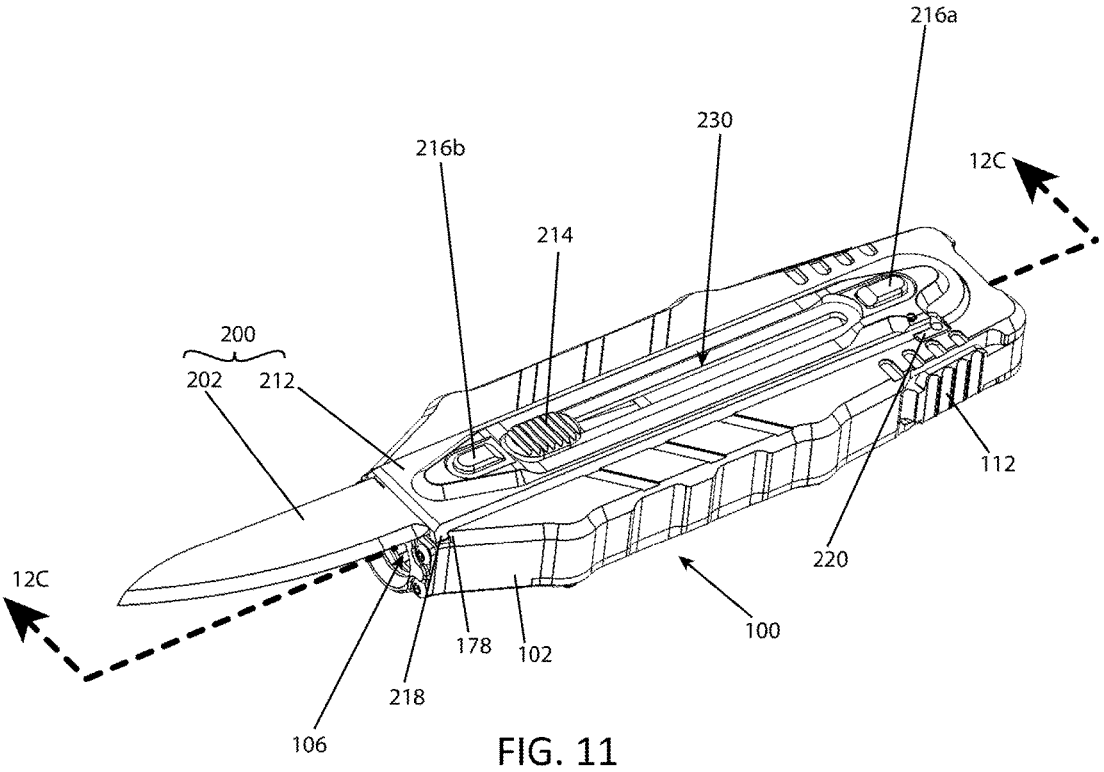
FIG. 11 illustrates a perspective view of a handheld lighting device with a blade of a knife assembly extended in accordance with an embodiment of the disclosure.

FIG. 11 shows handheld lighting device 100 with knife 202 extended from sleeve 212 in accordance with an embodiment of the disclosure. In an embodiment, sliding mechanism 214 may be moved by a user toward safety mechanism 216*b* to extend knife 202 from sleeve 212 in an extended position. Safety mechanism 216*b* may maintain the extended position of knife 202 and prevent movement of knife 202 such that knife 202 may be used to cut on a desired work area without knife 202 retracting into sleeve 212. Sliding mechanism 214 is at least partially disposed in channel 230 of sleeve 212 and may abut an end of channel 230 to prevent knife 202 from being completely removed from sleeve 212 in the extended position. In another embodiment, sliding mechanism 214 may be moved along channel 230 toward safety mechanism 216*a* to retract knife 202 such that knife 202 may be completely covered by sleeve 212 and in a retracted position. Safety mechanism 216*a* may prevent knife 202 from being displaced within sleeve 212 and thus prevent sliding mechanism 214 from moving toward safety mechanism 216*b* and extending knife 202. Sliding mechanism 214 may abut an end of channel 230 closest to safety mechanism 214*a* when knife 202 is in the retracted position.

Figure 12A:
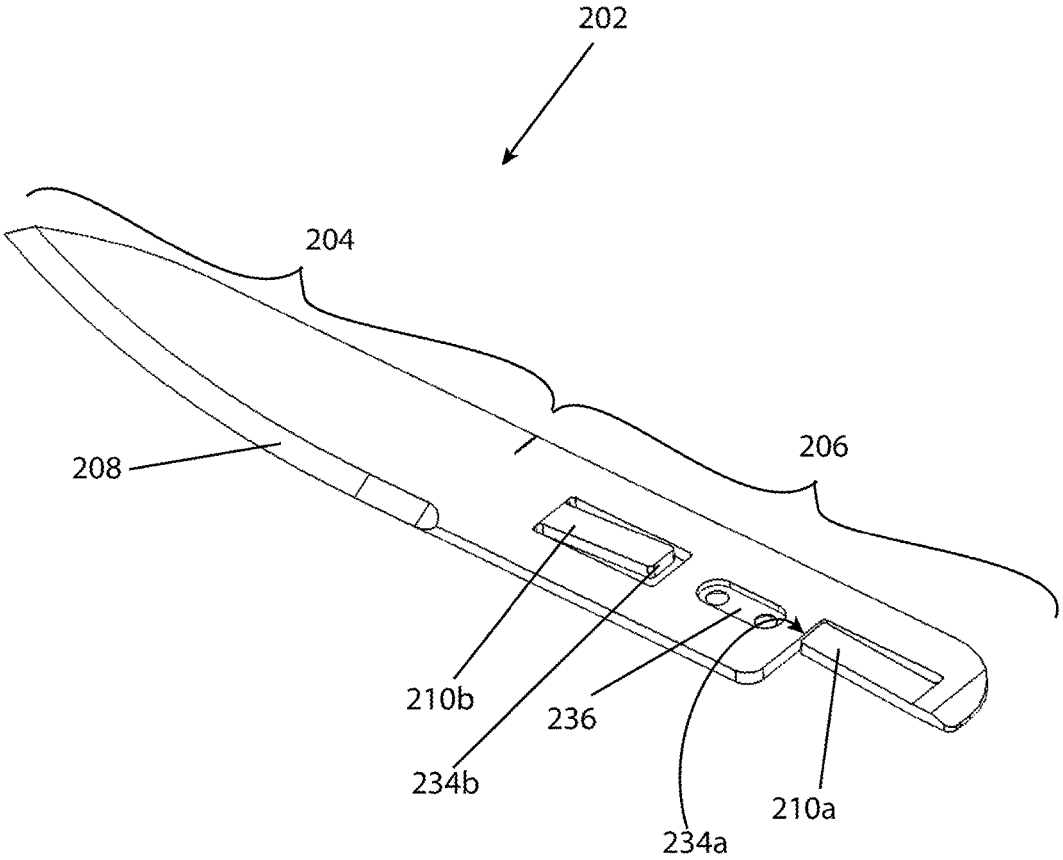
FIG. 12A illustrates a perspective view of a blade of a knife assembly in accordance with an embodiment of the disclosure.

FIG. 12A illustrates knife 202 in accordance with an embodiment of the disclosure. Knife 202 may include a knife blade 204 and a knife base 206 (e.g., tang). Blade 204 may provide an edge 208 for cutting a work area and base 206 may include tabs 210*a* and 210*b*, with abutment surfaces 234*a* and 234*b*, respectively, and a mounting surface 236. In an embodiment, mounting surface 236 may provide one or more holes, allowing sliding mechanism 214 to secure to base 206. In this regard, a user may impart a force on sliding mechanism 214 and thus on knife 202, translating (e.g., moving in a fore and aft direction parallel to axis 310) knife 202 within sleeve 212 in response to a translation of sliding mechanism 214 along channel 230 by the user.

Figure 12B:
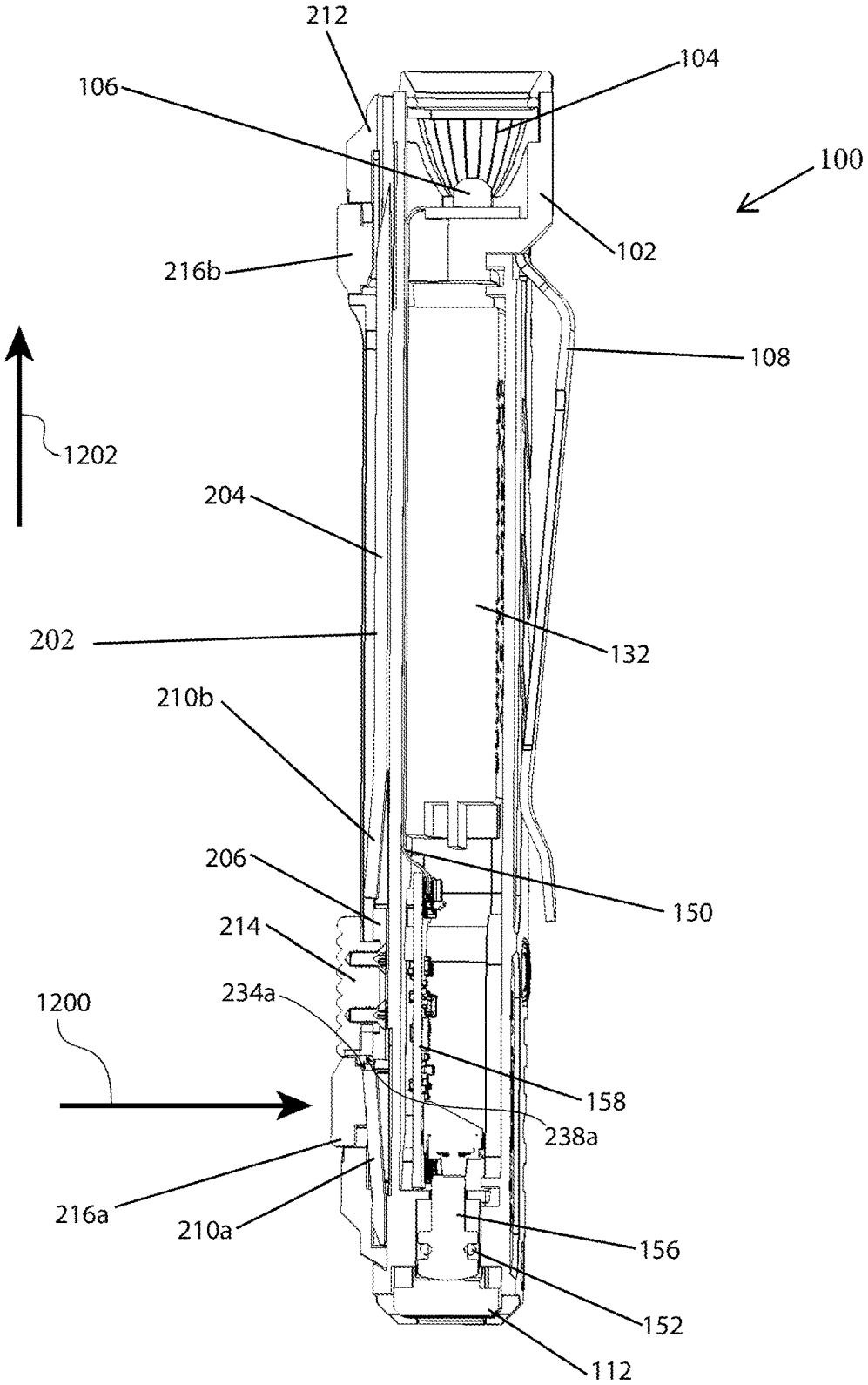
FIG. 12B illustrates a cross-sectional right side view of a handheld lighting device with a blade retracted taken along line 12B-12B of FIG. 2 in accordance with an embodiment of the disclosure.
Figure 12C:
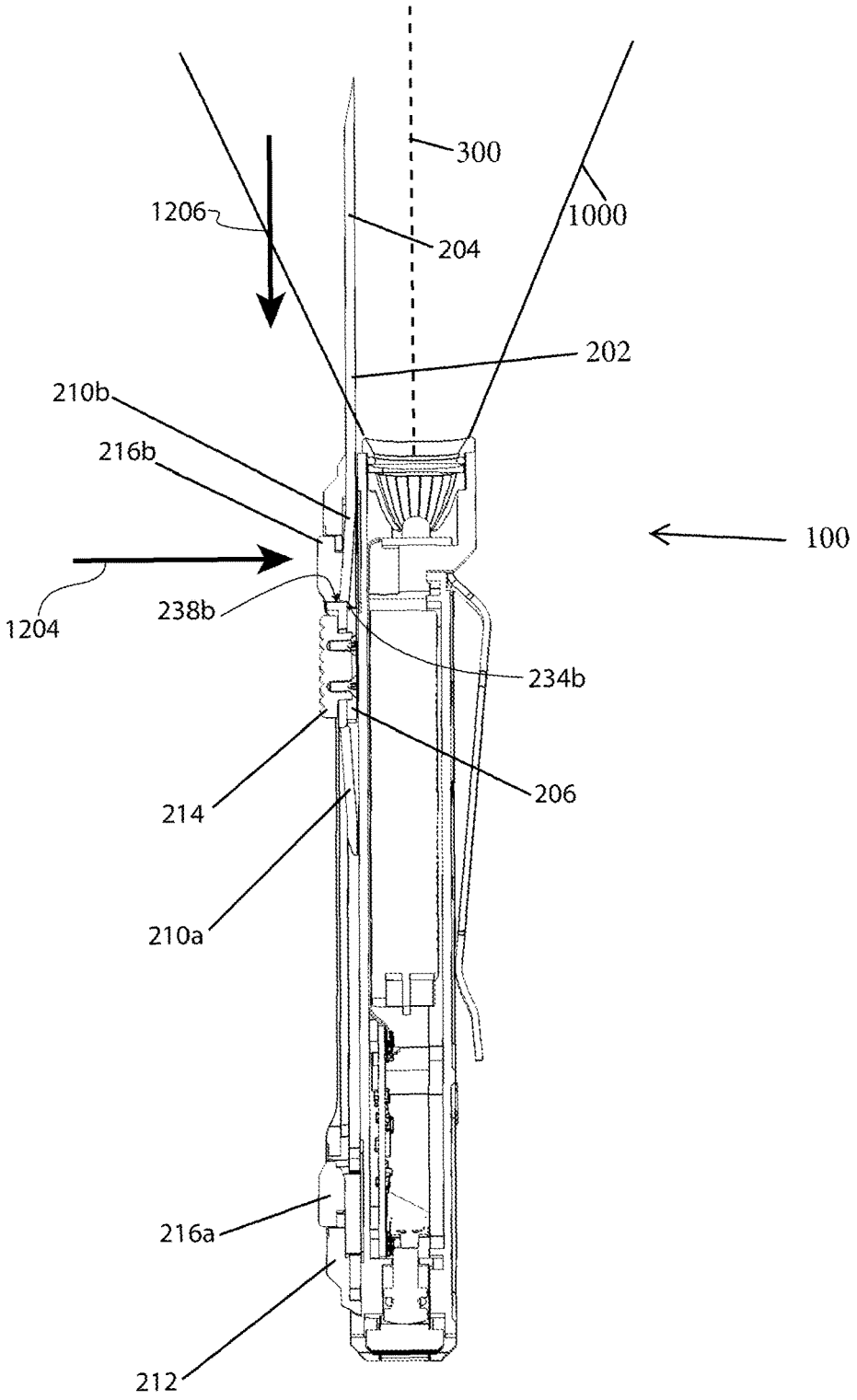
FIG. 12C illustrates a cross-sectional right side view of a handheld lighting device with a blade extended taken along line 12C-12C of FIG. 11 in accordance with an embodiment of the disclosure.

FIG. 12B illustrates a cross-sectional right side view of lighting device 100 with blade 204 in the retracted position taken along line 12B-12B of FIG. 2 in accordance with an embodiment of the disclosure. In an embodiment, knife 202 may be in the retracted position with sliding mechanism 214 abutting the end of channel 230 adjacent to safety mechanism 216*a*. In an embodiment, tab 210*a* may be biased in a direction toward sleeve 212 (e.g., biased in a first direction). For example, tab 210*a* may be angled relative to base 206 (e.g., angled relative to longitudinal axis 310) toward sleeve 212 and away from lighting device 100. Tab 210*a* may abut safety mechanism 216*a* and engage a stop 238*a* of sleeve 212 with abutment surface 234*a*, thus maintaining the retracted position of knife 202 and preventing blade 204 from being unintentionally moved within sleeve 212 or edge 208 from being unintentionally exposed. In an embodiment, sleeve 212 may provide stop 238*a* which may engage tab

210*a* while biased in a first direction to prevent the translation of sliding mechanism 214.

User-operable safety mechanism 216*a* of knife assembly 200 may be depressed in a direction 1200 (e.g., in a direction perpendicular to longitudinal axis 310) such that safety mechanism 216*a* biases tab 210*a* in a second direction to disengage tab 210*a* from stop 238*a* to permit the translation of sliding mechanism 214 along a direction 1202. For example, safety mechanism 216*a* pushes tab 210*a* away from sleeve 212 and toward slot 116 of lighting device 100 along direction 1200. Therefore, tab 210*a* may be pushed toward lighting device 100 by safety mechanism 216*a* (e.g., the angle of tab 210*a* may be decreased and tab 210*a* may be relatively aligned with base 206 in response to the depression of safety mechanism 216*a*), tab 210*a* may be pushed away from stop 238*a*, thus disengaging abutment surface 234*a* and stop 238*a*, and tab 210*a* may move past stop 238*a* of sleeve 212 when sliding mechanism 214 is moved along a direction 1202 (e.g., along a direction relatively parallel to longitudinal axis 310), thus moving knife 202 in direction 1202 and extending knife 202 such that knife blade 204 may extend past an opening 246 (see FIG. 7) of lighting device 100. As a result, knife edge 208 may be exposed and knife assembly 200 may be operated by a user to cut a desired surface.

Sliding mechanism 214 and knife 202 may be moved until tab 210*b* passes a stop 238*b* and abuts safety mechanism 216*b* in the extended position, as shown in FIG. 12C. FIG. 12C illustrates a cross-sectional right side view of lighting device 100 with blade 204 extended taken along line 12C-12C of FIG. 11 in accordance with an embodiment of the disclosure.

In an embodiment, tab 210*b* may be biased in a direction toward sleeve 212 (e.g., biased in a first direction). Tab 210*b* may be angled relative to base 206 toward sleeve 212 and away from slot 116 of lighting device 100. Tab 210*b* may abut safety mechanism 216*b* and engage a stop 238*b* of sleeve 212 with abutment surface 234*b*, thus maintaining the extended position of knife 202 and preventing blade 204 from being unintentionally retracted into sleeve 212. In this regard, tab 210*b* may be at an angle relative to base 206 (e.g., angled relative to longitudinal axis 310 in a direction opposite of tab 210*a*) and provide abutment surface 234*b*, which abuts stop 238*b* of sleeve 212, thus preventing blade 204 from being retracted through opening 246 (see FIG. 7) into sleeve 212. For example, tab 210*b* may prevent knife blade 204 from retracting while a user is cutting with knife assembly 200.

In an embodiment, sleeve 212 may provide stop 238*b* which may engage tab 210*b* while biased in a first direction to prevent the translation of sliding mechanism 214. User-operable safety mechanism 216*b* of knife assembly 200 may be depressed in a direction 1204 (e.g., in a direction perpendicular to longitudinal axis 310) such that safety mechanism 216*b* biases tab 210*b* in a second direction to disengage tab 210*b* from stop 238*b* to permit the translation of sliding mechanism 214 along a direction 1206. For example, safety mechanism 216*b* may be depressed and, in response, the angle of tab 210*b* may be decreased and tab 210*b* may become relatively aligned with base 206, thus abutment surface 234*b* may no longer abut stop 238*b*. Therefore, sliding mechanism 214 may be moved along channel 230 in direction 1206, thus moving knife 202 from the extended position and retracting blade 204 through opening 246 so that blade 204 is at least partially enclosed by sleeve 212.

In one or more embodiments, light source 106 may be activated (e.g., turned on) and may generate light beam 1000. In an embodiment, light beam 1000 may be, for example, symmetrically projected along a longitudinal axis 300 (shown in FIGS. 1 and 12C) to at least partially illuminate the work area knife 202 is cutting along when knife assembly 200 is secured to lighting device 100. In another embodiment, light beam 100 may be, for example, asymmetrically projected along longitudinal axis 300 to at least partially illuminate the work area knife 202 is cutting on. Light beam 1000 may illuminate a volume, area, or surface of interest (e.g., work area) external to housing 102 and allow a user to readily see blade 204 and the work area such that the user may accurately and safely use knife 202 on the work area. In one or more embodiments, light beam 1000, may intersect blade 204 and simultaneously illuminate blade 204 and the desired work area. In an embodiment, light beam 1000 may be adjustable. For example, the angle of light beam relative to housing 102 and/or knife 202 may be varied by a user via electrical or mechanical communication (e.g., using user controls to position reflector 104 and/or light source 106 relative to housing 102 to vary, for example, the angle of the longitudinal axis of light beam 1000 relative to longitudinal axis 300 of lighting device 100). In another example, the operation of light beam 1000 may be varied using, for example, user controls, such as adjustment mechanism 114. In another example, the wavelength (e.g., color) of light beam 1000 may be adjustable via, for example, other user controls.

Figure 3:
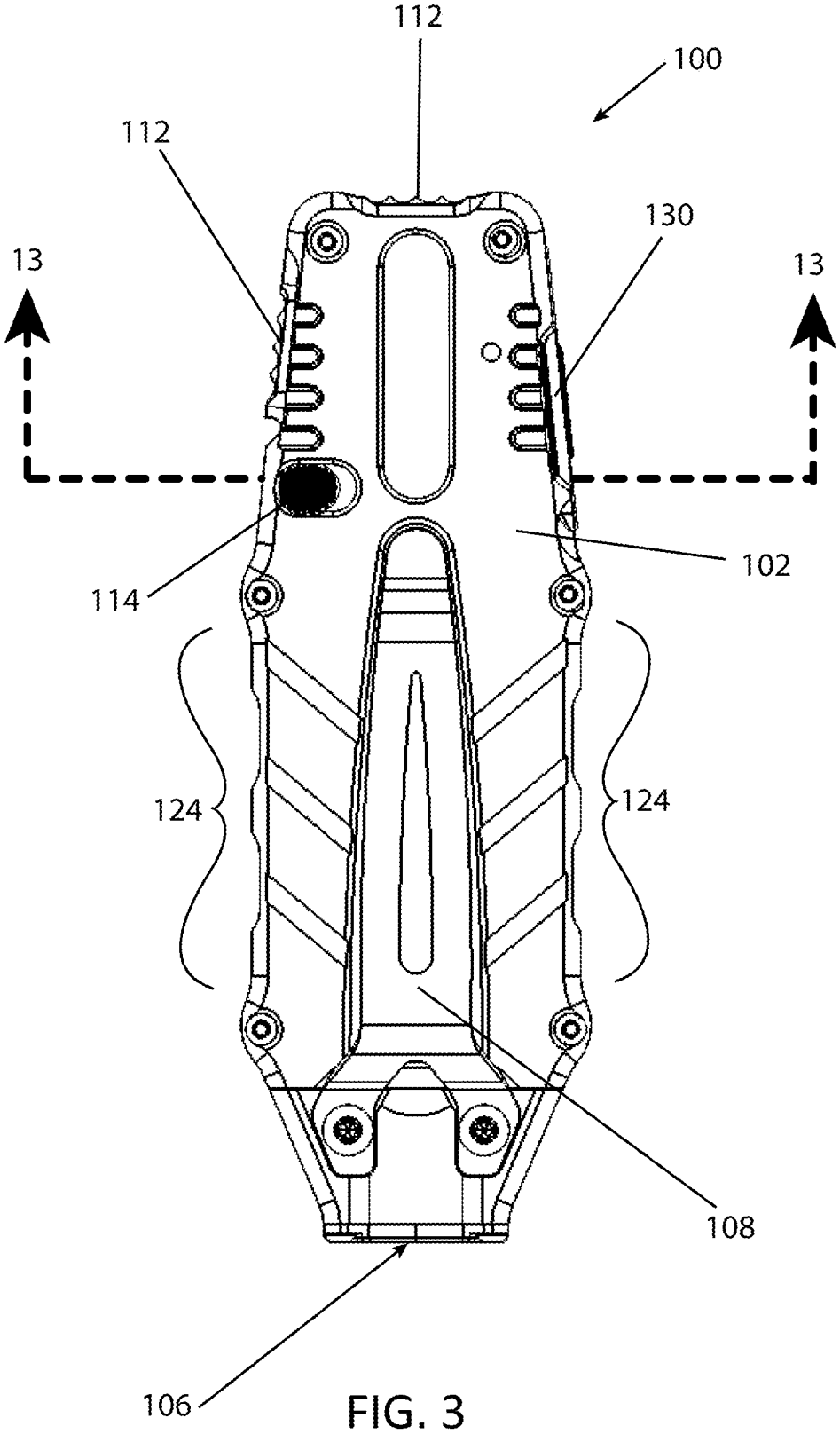
Figure 13:
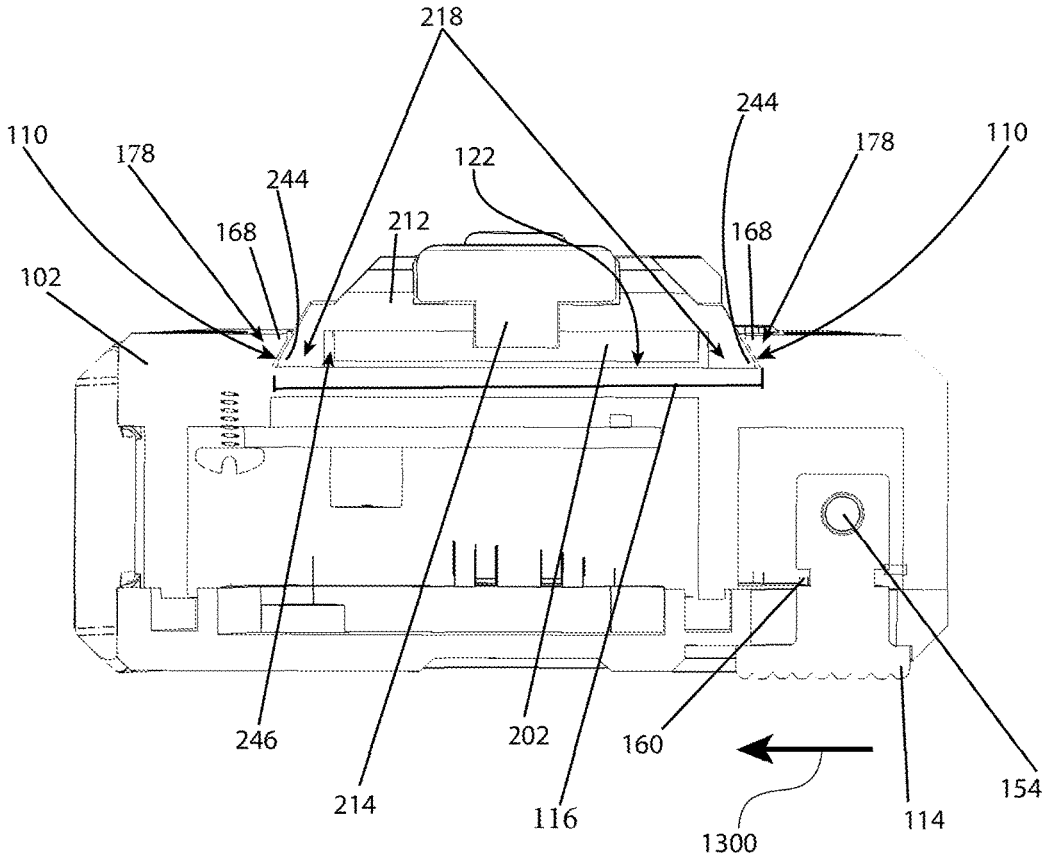
FIG. 13 illustrates a cross-sectional rear elevational view of the handheld lighting device taken along line 13-13 of FIG. 3 in accordance with an embodiment of the disclosure.

FIG. 13 illustrates a cross-sectional rear elevational view of lighting device 100 taken along line 13-13 of FIG. 3 in accordance with an embodiment of the disclosure. In one or more embodiments, sleeve 212 may provide engagement members 218 that extend along the perimeter of sleeve 212. Engagement members 218 may provide elongate wedge-shaped tongues 244 disposed at least partially about the perimeter of sleeve 212 that may slide into complementary grooves 110 (e.g., tracks) of housing 102. Housing 102 may have coupling members 178 that have sidewalls 168. Sidewalls 168 may provide portions that are elevated relative to a recessed outer surface 122 of slot 116. At least portions of sidewalls 168 are on opposite sides of outer surface 122 and may define slot 116. The elevated portions of the sidewalls may be disposed away from outer surface 122 of slot 116 to define grooves 110 between the elevated portions and outer surface 122. Therefore, housing 102 may have slot 116, which may have sidewalls 168 with grooves 110 defined therein and able to receive engagement members 218 of sleeve 212 along a first direction (e.g., in a direction relatively parallel to axes 300 and 310) to selectively couple and decouple knife assembly 200 in relation to housing 102. Therefore, grooves 110 may be elongate voids that may receive tongues 244 of sleeve 212 to prevent translation of knife assembly 200 in a second direction orthogonal to the first direction (e.g., in a direction relatively perpendicular to axes 300 and 310). Grooves 110 may each form an acute angle with outer surface 122 to prevent sleeve 212 from moving in the second direction when secured to housing 102.

In an embodiment, grooves 110 may be implemented as a singular elongate void such that slot 116 may have an arcuate-shaped termination and an open end, as shown in the figures, or a linear termination (e.g., slot 116 may be an elongate rectangular or polygonal-shape). In another embodiment, grooves 110 may be implemented as two separate and opposing voids such that slot 116 may have two open ends. Opposing grooves 110 may extend under elevated portions of sidewalls 168 and define slot 116, which may receive corresponding elongated tongues 244 of engagement members 214 of knife assembly 200 in a tongue-and-groove engagement and secure sleeve 212 to housing 102.

As shown in FIG. 13, engagement members 214 may be positioned within grooves 110 of housing 102 such that elevated portions of sidewalls 168 are disposed above tongues 244, thus securing knife assembly 200 to lighting device 100 through engagement of tongues 244 with grooves 110. Locking member 220 may be provided to prevent movement of sleeve 212 in the first direction and completely secure knife assembly 200 to lighting device 100, as discussed further herein.

In one or more embodiments, adjustment mechanism 114 may be moved to select between different modes of operation associated with light beam 1000 generated by light source 106. For example, in a first mode of operation, adjustment mechanism 114 may be set at a primary position. While adjustment mechanism is in the primary position, successive actuations of user control 112 may cause light source 106 to cycle between different output levels (e.g., such that light beam 1000 cycles from off to low, medium, high, and back to off; other levels are also contemplated).

In a second mode of operation, adjustment mechanism 114 may be moved (e.g., slid) from the primary position to a secondary position by being pushed in a direction 1300 toward longitudinal axis 300 (e.g., in a direction perpendicular to longitudinal axis 300) of lighting device 100. While adjustment mechanism 114 is in the secondary position, actuation of user control 112 may cause light source 106 to switch between full off operation (e.g., such that light beam 1000 is not provided) and full on operation (e.g., such that light beam 1000 is provided at maximum brightness) to provide reliable maximum light in tactical situations. In some embodiments, while in the second mode of operation, light source 106 may provide maximum brightness in a momentary fashion while user control 112 is temporarily held in an actuated position by a user, and then return to zero brightness user control 112 is released. In other embodiments, while in the second mode of operation, light source 106 may cycle between maximum brightness and zero brightness in response to successive actuations of user control 112. Adjustment mechanism 114 may be moved (e.g., slid) from the secondary position back to the primary position by moving adjustment mechanism 114 in a direction opposite of directional arrow 1300 and away from longitudinal axis 300 to change back to the first mode of operation.

Figure 16A:
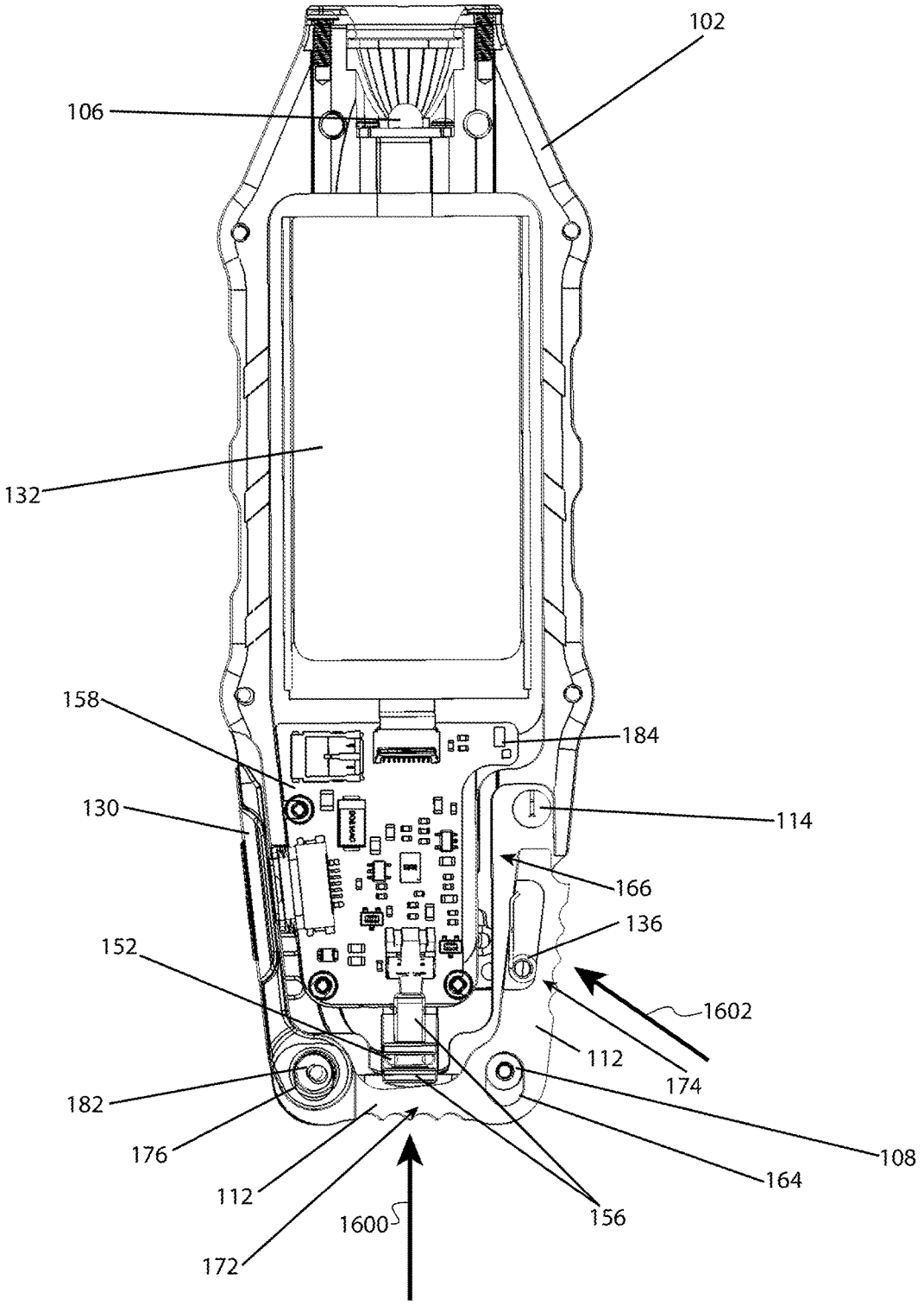
FIG. 16A illustrates a cross-sectional bottom plan view of a handheld utility device taken along line 16A-16A of FIG. 5 in accordance with an embodiment of the disclosure.

In one or more embodiments, adjustment mechanism 114 may be a Hall effect user control providing a magnet 154. Circuit board 158 may provide the Hall effect sensor 184 (as shown in FIGS. 9 and 16A) positioned within a proximity from adjustment mechanism 114 such that Hall effect sensor 184 may detect the movement of magnet 154 in response to the movement of adjustment mechanism 114 by a user.

Figure 14A:
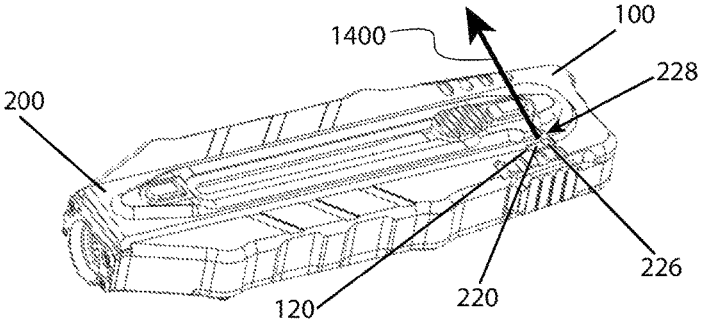
FIG. 14A illustrates a perspective view of a knife assembly engaged with a handheld lighting device in accordance with an embodiment of the disclosure.
Figure 14B:
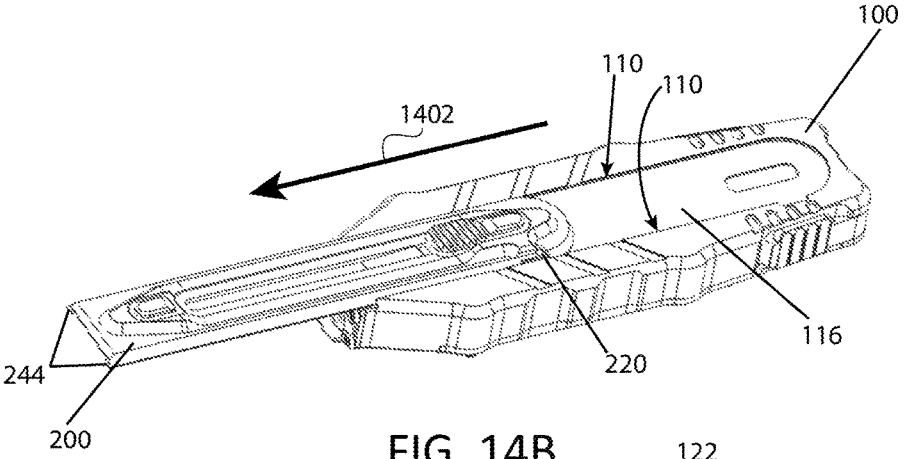
FIG. 14B illustrates a perspective view of a knife assembly partially disengaged from a handheld lighting device in accordance with an embodiment of the disclosure.
Figure 14C:
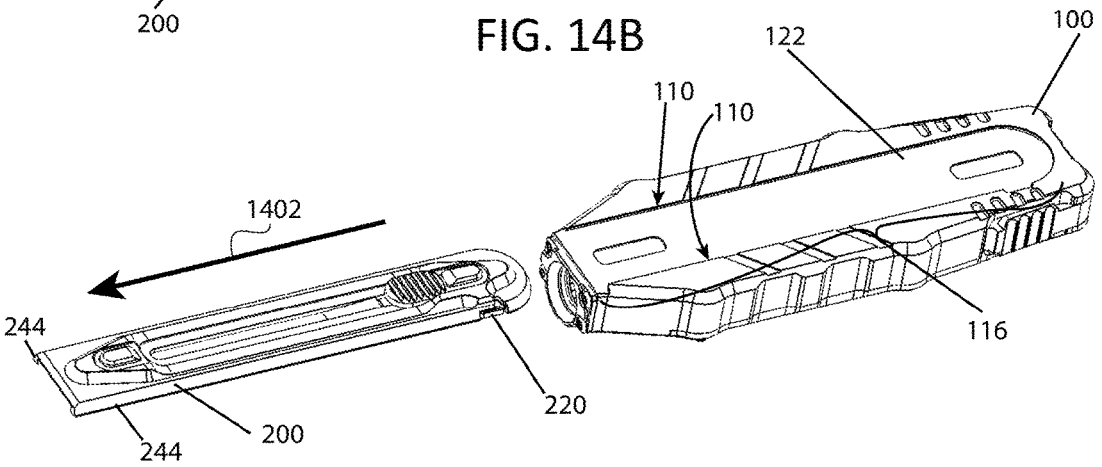
FIG. 14C illustrates a perspective view of a knife assembly completely disengaged from a handheld lighting device in accordance with an embodiment of the disclosure.

The mechanical engagement of knife assembly 200 with lighting device 100 can be further understood with reference to FIGS. 14A-14C. In FIG. 14A, knife assembly 200 is completely engaged with handheld lighting device 100 in accordance with an embodiment of the disclosure. Knife assembly 200 is in an engaged position and thus fully secured to lighting device 100. Sleeve 112 is completely received by slot 116 and tongues 244 are fully slid into grooves 110 such that knife assembly 200 is secured to housing 102 of lighting device 100.

Sleeve 212 may provide locking member 220 and housing 102 may provide a complementary recess 120 disposed on housing 102 and configured to receive locking member 220 (e.g., a securing panel) of knife assembly 200 to ensure sleeve 212 is secured to housing 102. Recess may be in at least one of sidewalls 168 of slot 116 and may receive locking member 220 to secure sleeve 212 within slot 116. Recess 120 may be a relatively complementary shape to locking member 220 and provide contact surfaces preventing locking member 220 from being displaced when engaged with recess 120 as discussed further herein.

An indentation 226 may be engaged by, for example, a tool such as a pin with a relatively complementary shape relative to indentation 226, to move locking member 220. Locking member 220 may be pushed in direction 1400 toward longitudinal axis 310 (e.g., relatively perpendicular to longitudinal axis 310) and away from recess 120 in housing 102. A notch 228 may be provided in engagement members 218 such that the tool may completely push locking member 220 so locking member 220 does not protrude outward from sleeve 112. In this regard, locking member 220 may be moved away from recess 120 until locking member 220 is completely removed from recess 120 and substantially flush relative to engagement members 218 of sleeve 212.

In FIG. 14B, locking member 220 has been moved until relatively flush with engagement members 218, and sleeve 212 has been slid (e.g., a relatively rectilinear motion guided by grooves 110 of sidewalls 168) out of slot 116 in a direction 1402 (e.g., relatively parallel to longitudinal axis 310) such that sleeve 212 is partially disengaged from lighting device 100 and thus in a partially disengaged position. In this regard, knife assembly 200 has been pushed in direction 1402 so that sleeve 212 is only partially received by slot 116.

In FIG. 14C, knife assembly 200 is completely disengaged from lighting device 100 after proceeding to move knife assembly in direction 1402. Knife assembly 200 is in a disengaged position and thus completely detached from lighting device 100. In another embodiment, knife assembly 200 may engage lighting device 100, for example, by reversing the sliding operation (e.g., moving sleeve 212 in a direction opposite of directional arrow 1402) such that knife assembly is received by slot 116 and then locking member 220 is moved in a direction opposite of directional arrow 1400 such that locking member 220 is received by recess 120, thus preventing knife assembly 200 from being displaced or removed from slot 116 and securing knife assembly 200 to lighting device 100.

Figure 15:
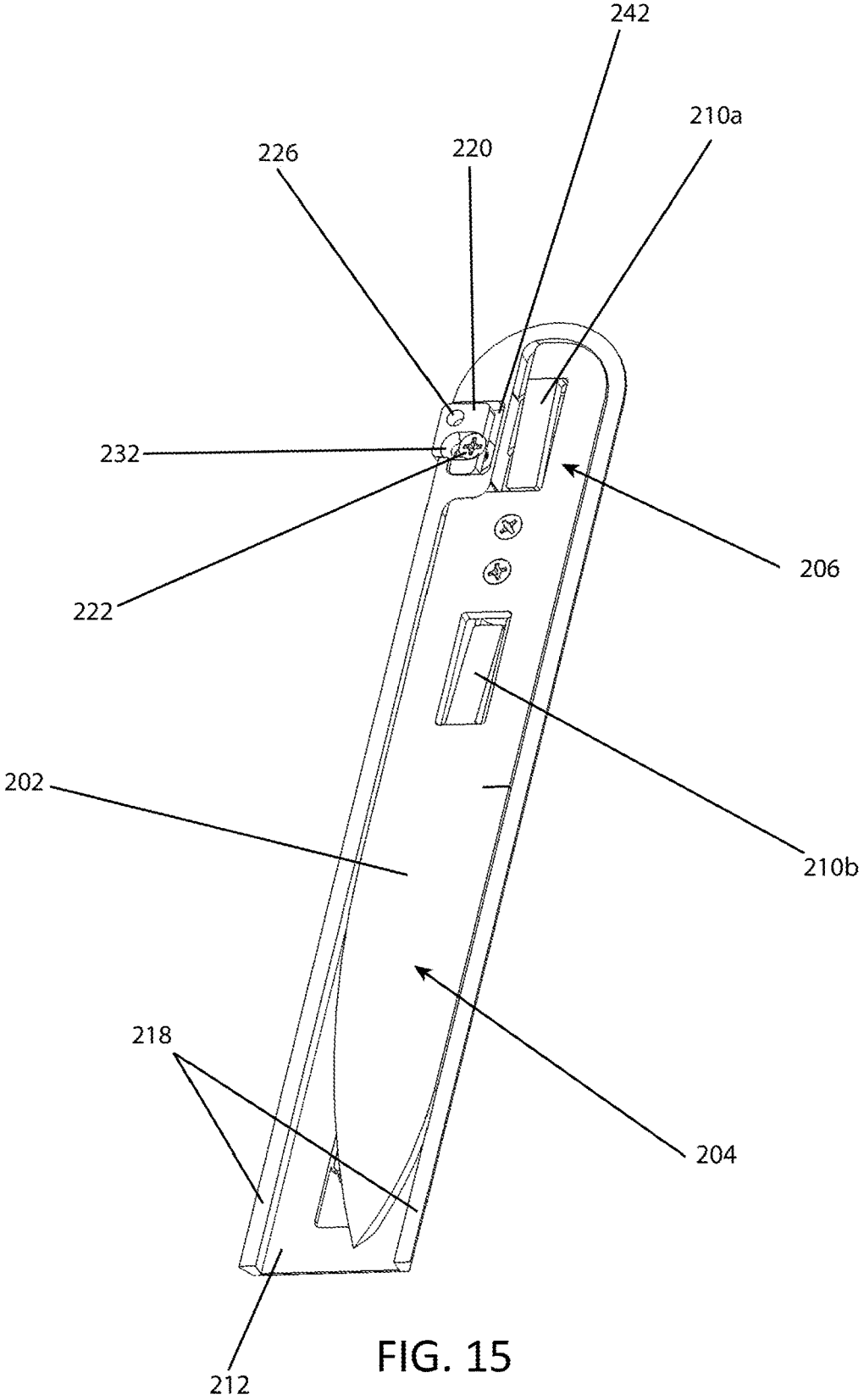
FIG. 15 illustrates a perspective view of a knife assembly in accordance with an embodiment of the disclosure.

FIG. 15 illustrates a perspective view of knife assembly 200 in accordance with an embodiment of the disclosure. Knife 202 is at least partially enclosed by sleeve 212. Locking member 220 is disposed in a complementary cutout in sleeve 212 with a gap 242 between locking member 220 and sleeve 212. Locking member 220 may be coupled to sleeve 212 with screw 222 and o-ring 224 (see FIG. 9). Screw 224 goes through an elongate aperture 232 of locking member 220. Locking member 220 may be moved (e.g., slid) toward blade 202 using indentation 226, as described herein, and thus may decrease gap 242 until locking member 220 abuts the adjacent wall of sleeve 212 and locking member 220 is relatively flush with corresponding engagement members 218. In one or more embodiments, locking member 220 is slid to diminish gap 242 and fixed screw 222 may abut the opposing end of elongated aperture 232.

Figure 5:
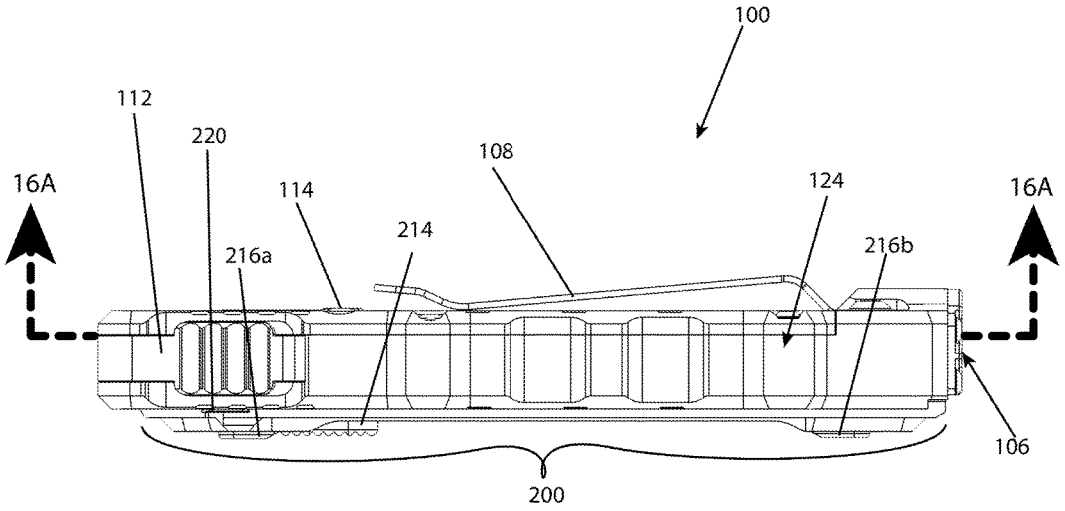
Figure 6:
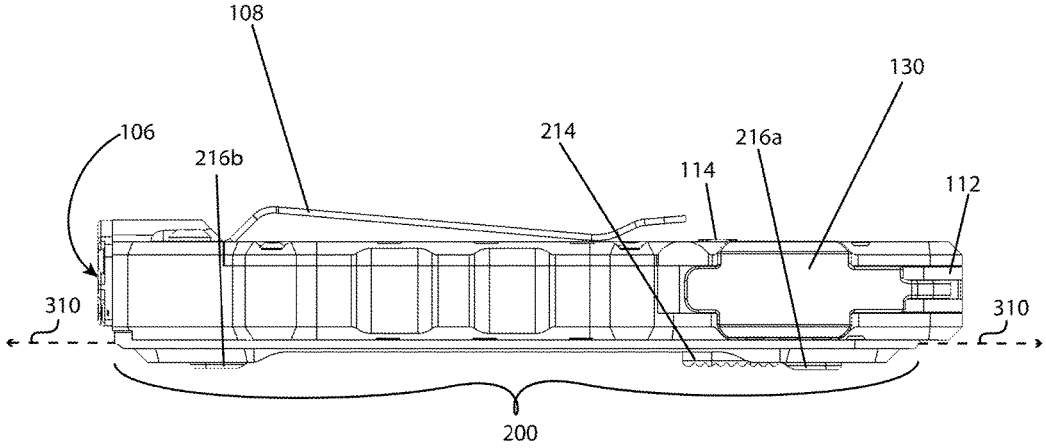
Figure 7:
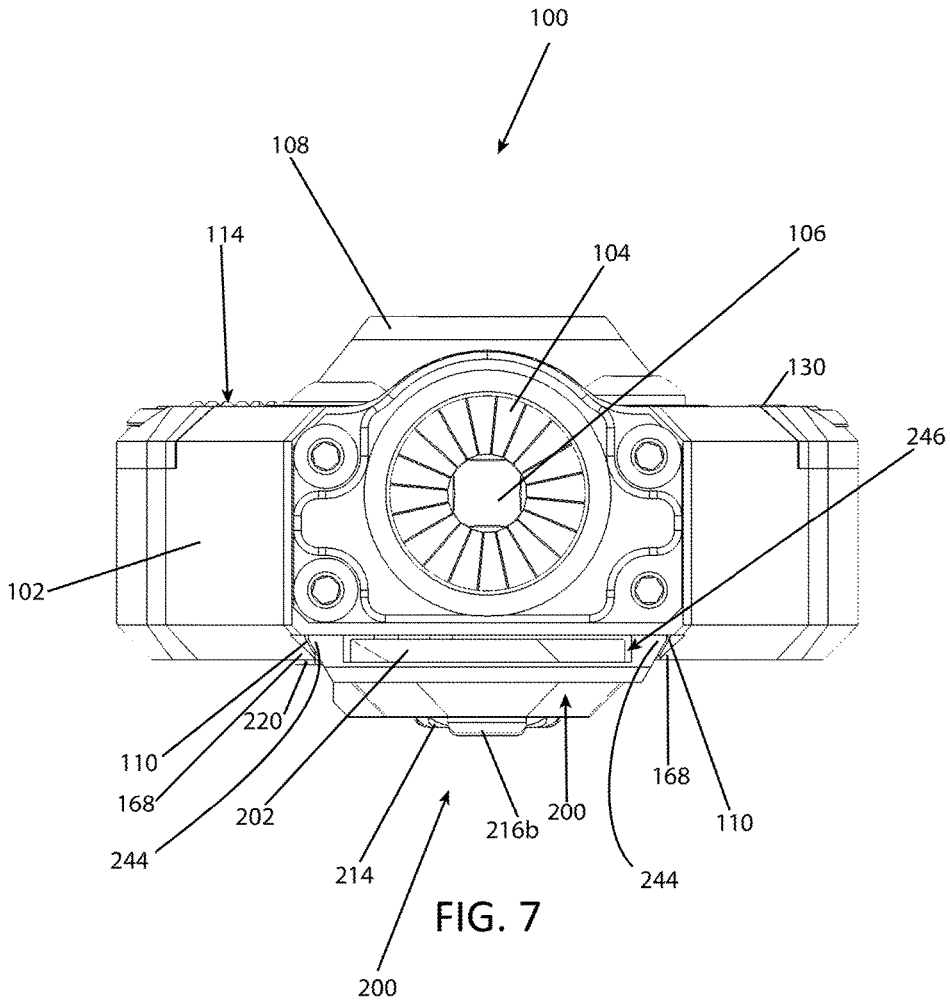
Figure 8:
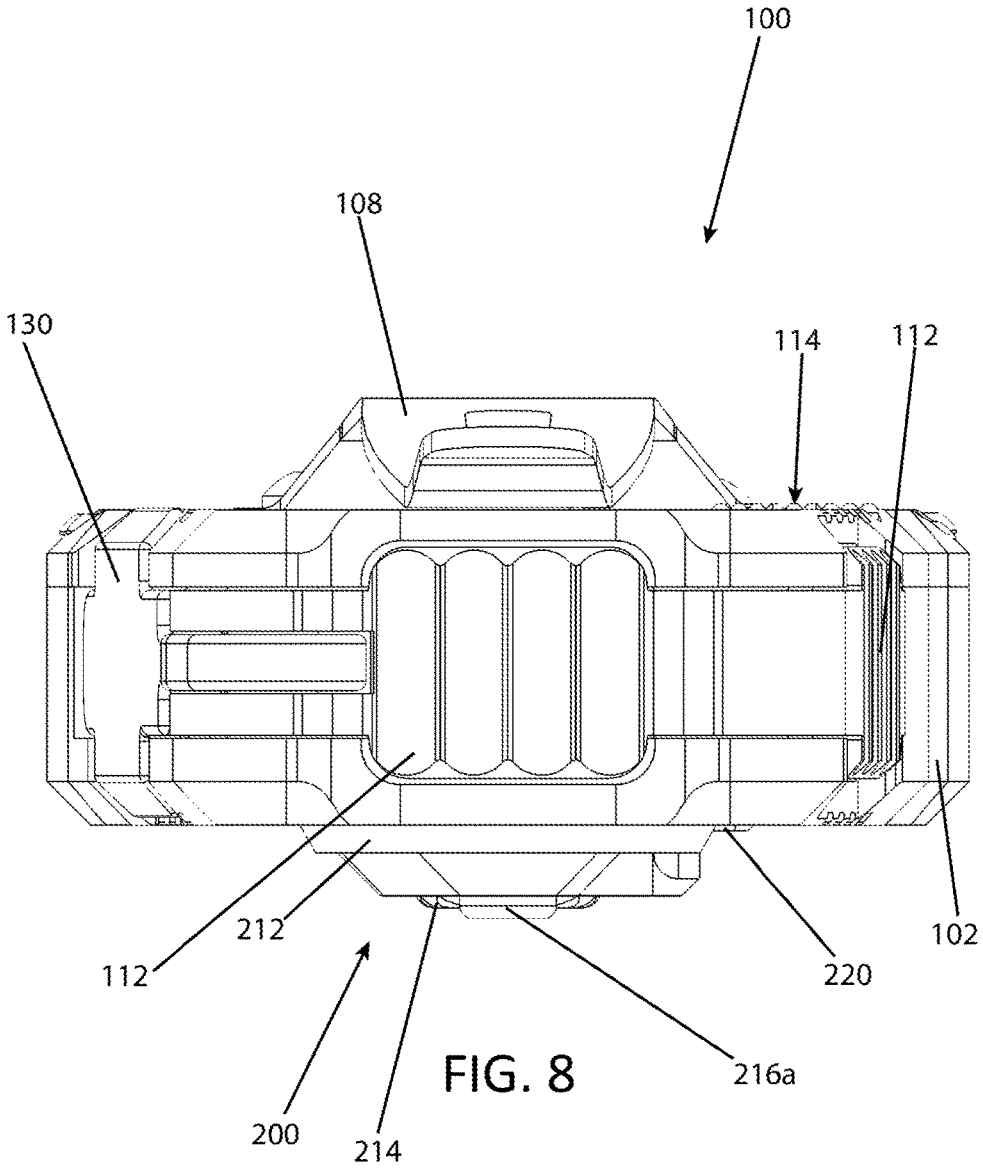

FIG. 16A illustrates a cross-sectional view of lighting device 100 taken along line 16A-16A of FIG. 5 in accordance with an embodiment of the disclosure. Light source 106 may be activated by actuating multi-access user control 112. Multi-access user control 112 may be secured to housing 102 using various screws 140, such as screws 180 and 182. Multi-access user control 112 may provide apertures 164 and 176, which screws 180 and 182 are disposed in, respectively. Aperture 164 may be an elongate aperture that allows displacement of multi-access user control 112 relative to housing 102. In one or more embodiments, user control 112 may be actuated by a user using various surfaces provided by user control 112. User control 112 may have a primary actuation surface 172 and a secondary actuation surface 174 (also referred to herein as a "primary surface" and a "secondary surface," respectively). Primary surface 172 and secondary surface 174 may each be actuated to operate light source 106 in response to corresponding first and second user actuations, respectively. User control 112 may be a substantially L-shaped user control with primary actuation surface 172 disposed along a first axis 340 and secondary actuation surface 174 disposed along a second axis 340 (as shown in FIG. 16B).

In an embodiment, user control 112 may receive the first user actuation in a first direction toward primary surface 172 and translate laterally (e.g., in a direction 1600) in response thereto. User control 112 may receive the second user actuation in a second direction (e.g., in a direction 1602) toward secondary surface 174 and simultaneously pivot and translate laterally in response thereto. For example, a user may depress primary surface 172 such that user control 112 is moved in direction 1600, thus resulting in primary surface 172 abutting and depressing actuating pin 156, which is in communication with support circuitry 1016 of circuit board 158. Controller 1010 may, through communication with support circuitry 1016, may detect the depression of actuating pin 156, to activate or deactivate light source 106 in response. In another embodiment, a user may depress secondary surface 174 such that user control 112 is moved in direction 1602, thus compressing biasing spring 136 and sliding user control 112 simultaneously such that actuating pin 156 is depressed by primary surface 172, thus activating or deactivating light source 106 in response.

Figure 16B:
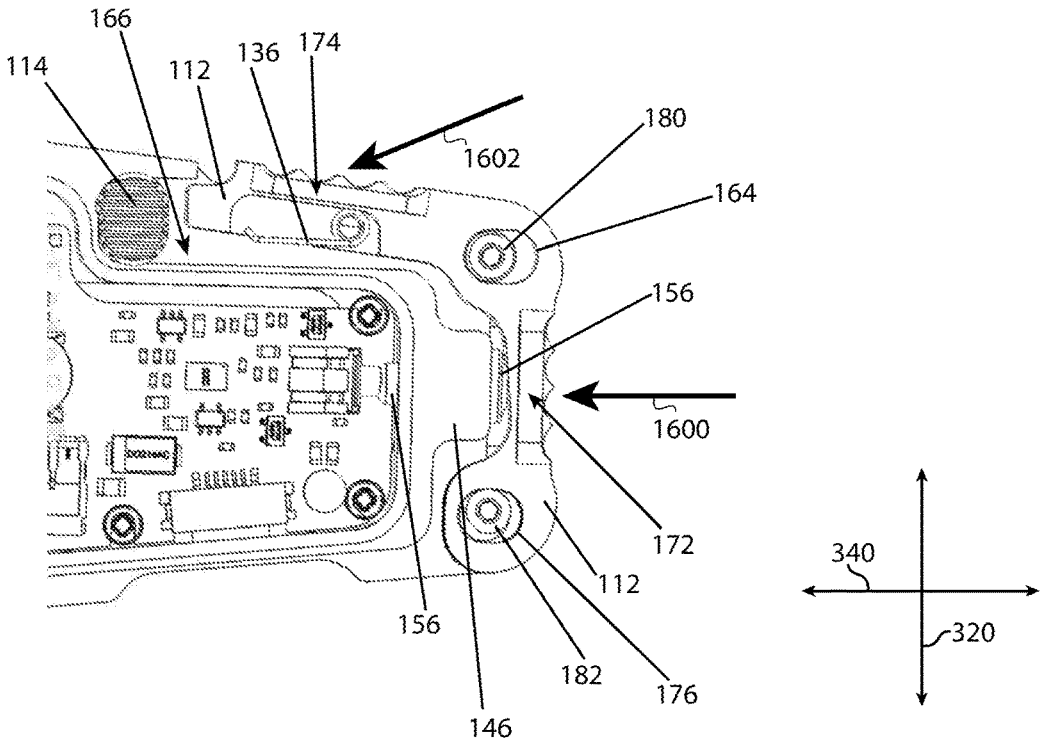
FIGS. 16B-16C illustrate a depression of a multi-access user control in accordance with embodiments of the disclosure.
Figure 16C:
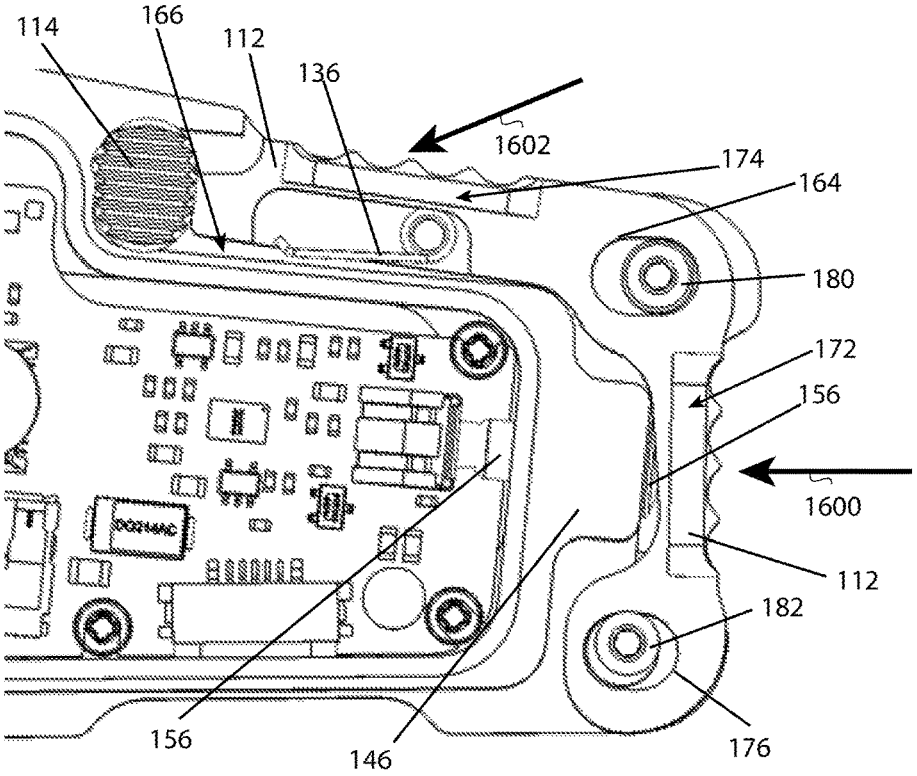

FIGS. 16B-16C illustrate the depression of user control 112 in accordance with an embodiment. Secondary surface 174 may be moved in direction 1602, thus resulting in the simultaneous pivoting and translating of multi-access user control 112. For example, secondary surface 174 may be depressed and/or slid in direction 1602. In response, gap 166 between user control 112 and housing 102 is decreased as multi-access user control 112 pivots about corresponding screw 182 of aperture 176. Biasing spring 136 may be compressed as a result. In response to the depressing and/or sliding of secondary surface 174, elongated aperture 164 may move about corresponding screw 180 such that screw 180 abuts an opposing surface when primary surface 172 or secondary surface 174 is depressed by a user. In response to the depressing and/or sliding of secondary surface 174, user control 112 thus may pivot at screw aperture 176 and primary surface 172 may depress actuating pin 156, which may communicate with circuit board 156 to activate or deactivate light source 106 of lighting device 100 in response.

Figure 17:
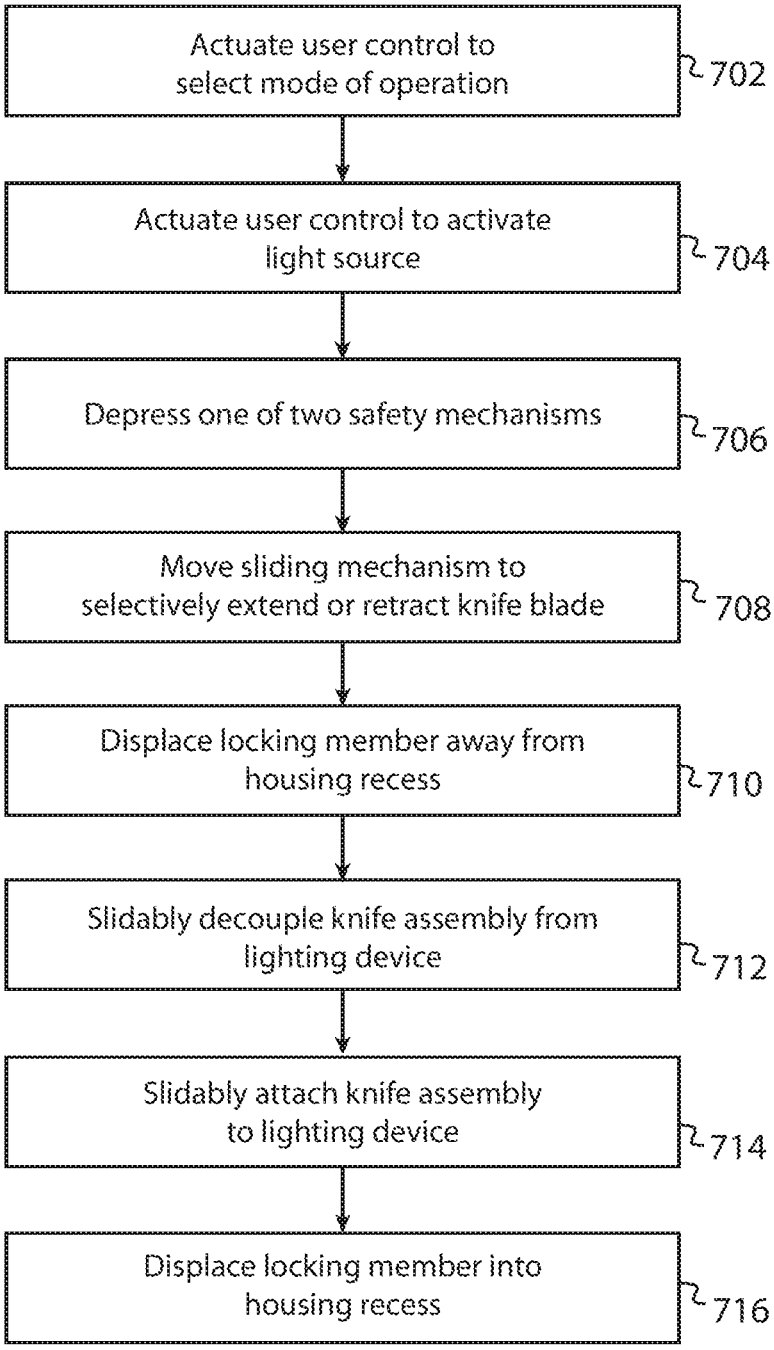
FIG. 17 illustrates a process of operating a handheld lighting device in accordance with an embodiment of the disclosure.

FIG. 17 illustrates a process of operating the handheld utility device in accordance with an embodiment of the disclosure. In block 702, adjustment mechanism 114 may be moved to select a first or second mode of operation as discussed which affects the various levels of brightness of light beam 1000 provided by light source 106 in response to actuations of user control 112 (see FIG. 3). For example, as discussed, adjustment mechanism 114 may be moved (e.g., slid) from a primary position to a secondary position by being pushed in a direction 1300. Adjustment mechanism 114 may be moved (e.g., slid) from the secondary position back to the primary position by moving adjustment mechanism 114 in a direction opposite of directional arrow 1300, as shown in FIGS. 13 and 16A. As discussed, in one or more embodiments, adjustment mechanism 114 may be a Hall effect user control providing a magnet 154. Circuit board 158 may provide the Hall effect sensor 184 (as shown in FIGS. 9 and 16A) positioned within a proximity from adjustment mechanism 114 such that Hall effect sensor 184 may detect the movement of magnet 154 in response to the movement of adjustment mechanism 114 by a user.

In block 704, a user may activate light source 106 by actuating multi-access user control 112. For example, the user may depress and/or slide user control 112 on either primary surface 172 or secondary surface 174 of the substantially L-shaped button, as discussed herein, to activate light source 106. In an embodiment, primary surface 172 may be depressed. In response to the depression of user-operable primary actuation surface 172 being depressed by a user, primary surface 172 may bias actuating pin 156, thus activating light source 106 (as shown in FIGS. 16A-C). In another embodiment, user-operable secondary actuation surface 174 may be depressed and/or slid in direction 1602, thus resulting in the simultaneous pivoting and translating of multi-access user control 112 (as shown in FIGS. 16A-C). In response, user control 112 may pivot about corresponding screw 182 of aperture 176 and primary surface 172 may depress actuating pin 156, which may communicate with circuit board 156 to activate or deactivate light source 106 of lighting device 100 in response.

Light source 106 may generate light beam 1000 in response to the actuation performed in block 704. In various embodiments, multiple actuations of user control 112 may be performed to cycle light source 106 between various brightness levels (e.g., for a first mode of operation while user control 114 is in the primary position) or between zero and maximum brightness (e.g., for a second mode of operation while user control 114 is in the secondary position). In various embodiments, user controls 112 and/or 114 may be selectively actuated by a user at any time as desired throughout the process of FIG. 17.

Figure 4:
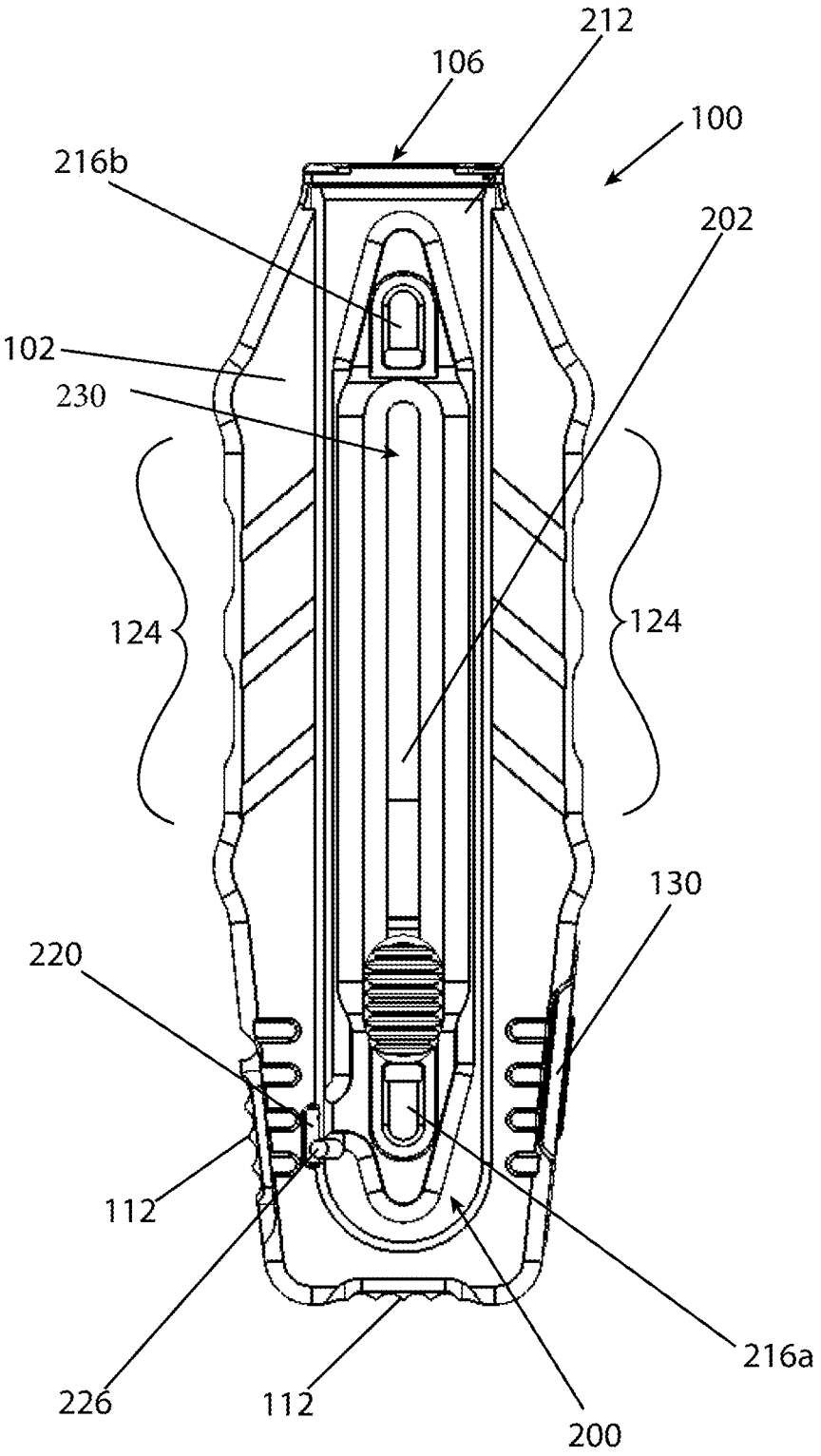

In block 706, safety mechanisms 216*a/b* may be depressed to allow knife 202 to move at least partially within sleeve 212, respectively. In an embodiment, tab 210*a* may be biased in a first direction toward sleeve 212. Tab 210*a* may abut safety mechanism 216*a* and engage a stop 238*a* of sleeve 212 with abutment surface 234*a*, thus maintaining the retracted position of knife 202 and preventing blade 204 from being unintentionally moved within sleeve 212 or edge 208 from being unintentionally exposed (as shown in FIGS. 2 and 4). In an embodiment, sleeve 212 may provide stop 238*a* which may engage tab 210*a* while biased in a first direction to prevent the translation of sliding mechanism 214. User-operable safety mechanism 216*a* of knife assembly 200 may be depressed in a direction, such as direction 1200 shown in FIG. 12B, such that safety mechanism 216*a* biases tab 210*a* in a second direction to disengage tab 210*a* from stop 238*a* to permit the translation of sliding mechanism 214 along a direction 1202.

In another embodiment, tab 210*b* may be biased in a direction toward sleeve 212 (e.g., biased in a first direction). Tab 210*b* may be angled relative to base 206 toward sleeve 212 and away from slot 116 of lighting device 100. Tab 210*b* may abut safety mechanism 216*b* and engage a stop 238*b* of sleeve 212 with abutment surface 234*b*, thus maintaining the extended position of knife 202 and preventing blade 204 from being unintentionally retracted into sleeve 212. For example, tab 210*b* may prevent knife blade 204 from retracting while a user is cutting with knife assembly 200. User-operable safety mechanism 216*b* of knife assembly 200 may be depressed in a direction 1204, as shown in FIG. 12C, such that safety mechanism 216*b* biases tab 210*b* in a second direction to disengage tab 210*b* from stop 238*b* to permit the translation of sliding mechanism 214 along a direction 1206 (as shown in FIG. 12C). For example, safety mechanism 216*b* may be depressed and, in response, the angle of tab 210*b* may be decreased and tab 210*b* may become relatively aligned with base 206, thus abutment surface 234*b* may no longer abut stop 238*b*.

After the depression of safety mechanisms 216*a/b*, sliding mechanism 214 may be translated within channel 230 to selectively extend or retract knife blade 204 (block 708). For example, after safety mechanism 216*a* is depressed, sliding switch 214 may be translated in direction 1202 (as shown in FIG. 12B), thus moving knife 202 in direction 1202 and extending knife 202 such that knife blade 204 may extend past an opening 246 (as shown in FIG. 11) of lighting device 100. As a result, knife edge 208 may be exposed and knife assembly 200 may be operated by a user to cut a desired surface.

In another example, after the depression of safety mechanism 216*b*, sliding mechanism 214 may be moved along channel 230 in direction 1206 (as shown in FIG. 12C), thus moving knife 202 from the extended position and retracting blade 204 through opening 246 so that blade 204 is at least partially enclosed by sleeve 212 (as shown in FIGS. 2 and 12B).

In block 710, locking member 220 may be displaced away from recess 120 (disposed in at least one sidewall 168) out of an engaged position (as shown in FIGS. 14A-C). Locking member 220 may be translated until relatively flush with the surface of the corresponding adjacent tongue 244. In this regard, locking member 220 is disengaged from recess 120, thus allowing knife assembly 200 to be slidably detached from housing 102 of lighting device 100.

In block 712, knife assembly 200 may be slidably decoupled from lighting device 100. For example, once locking member 220 has been moved until relatively flush with engagement members 218, sleeve 212 may be slid out of slot 116 in a direction 1402 such that sleeve 212 is partially disengaged from lighting device 100 (as shown in FIG. 14B). Knife assembly 200 may be completely disengaged from lighting device 100 after proceeding to move knife assembly in direction 1402 (as shown in FIG. 14C).

In block 714, knife assembly 200 may be slidably attached to lighting device 100. Knife assembly 200 may engage lighting device 100, for example, by reversing the sliding operation (e.g., moving sleeve 212 in a direction opposite of directional arrow 1402, as shown in FIG. 14C) such that knife assembly is received by slot 116 and then locking member 220 is moved in a direction opposite of directional arrow 1400 such that locking member 220 is received by recess 120, thus preventing knife assembly 200 from being displaced or removed from slot 116 and securing knife assembly 200 to lighting device 100 (block 716).

The disclosure is not intended to limit the present invention to the precise forms or particular fields of use disclosed. It is contemplated that various alternate embodiments and/or modifications to the present invention, whether explicitly described or implied herein, are possible in the rail clamp of the disclosure. For example, it is contemplated that the various embodiments set forth herein may be combined together and/or separated into additional embodiments where appropriate.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A lighting device comprising:

a housing configured to be gripped by a user;

a light source disposed at least partially within the housing and configured to project a light beam to illuminate an area of interest external to the housing;

a substantially L-shaped user control comprising a primary actuation surface disposed on a first axis of the L-shape and a secondary actuation surface disposed on a second axis of the L-shape, wherein each of the primary and secondary actuation surfaces are configured to operate the light source in response to corresponding first and second user actuations; and a knife assembly comprising:

a sleeve, a blade at least partially enclosed by the sleeve and coupled thereto, and wherein the knife assembly is configured to selectively decouple from the housing to permit the user to selectively operate the lighting device with the knife assembly and without the knife assembly.

2. The lighting device of claim 1, wherein the user control is configured to translate in response to the first user actuation and configured to translate and pivot in response to the second user actuation.

3. The lighting device of claim 2, wherein the lighting device further comprises a Hall effect control configured to adjust a mode of operation of the light source associated with the user control, wherein the light source is a first light source, the lighting device further comprises a second light source.

4. The lighting device of claim 1, wherein the user control is configured to:

receive the first user actuation and translate laterally in response thereto; and receive the second user actuation and simultaneously pivot and translate laterally in response thereto.

5. The lighting device of claim 1, wherein the housing comprises a slot having sidewalls with grooves defined therein and configured to slidably receive engagement members of the sleeve along a first direction to selectively couple and decouple the knife assembly in relation to the housing.

6. The lighting device of claim 5, wherein:

the engagement members comprise elongate tongues disposed at least partially about a perimeter of the sleeve; and the grooves comprise elongate voids configured to receive the tongues to prevent translation of the knife assembly in a second direction orthogonal to the first direction.

7. The lighting device of claim 5, wherein:

the sleeve comprises a locking member; and the housing comprises a recess in at least one of the sidewalls of the slot and configured to receive the locking member to secure the sleeve within the slot.

8. The lighting device of claim 1, wherein the knife assembly further comprises a user-operable sliding mechanism coupled to the blade and configured to extend and retract the blade from the sleeve in response to a translation of the sliding mechanism relative to the sleeve.

9. The lighting device of claim 8, wherein:

the blade comprises a tab biased in a first direction;

the sleeve comprises a stop configured to engage with the tab while biased in the first direction to prevent the translation of the sliding mechanism; and the knife assembly comprises a user-operable safety mechanism configured to bias the tab in a second direction to disengage the tab from the stop to permit the translation of the sliding mechanism.

10. The lighting device of claim 9, wherein the tab is a first tab, the stop is a first stop, the user-operable safety mechanism is a first user-operable safety mechanism, and wherein:

the blade further comprises a second tab biased in the first direction;

the sleeve further comprises a second stop configured to engage with the second tab while biased in the first direction to prevent the translation of the sliding mechanism; and the knife assembly further comprises a second user-operable safety mechanism configured to bias the second tab in the second direction to disengage the second tab from the second stop to permit the translation of the sliding mechanism.

11. The lighting device of claim 1, further comprising a laser aligned relative to the blade to direct a laser beam toward a work surface.

12. A method comprising:

providing a lighting device comprising:

a housing configured to be gripped by a user, a light source disposed at least partially within the housing and configured to project a light beam to illuminate an area of interest external to the housing, a substantially L-shaped user control comprising a primary actuation surface disposed on a first axis of the L-shape and a secondary actuation surface disposed on a second axis of the L-shape, wherein each of the primary and secondary actuation surfaces are configured to operate the light source in response to corresponding first and second user actuations; and a knife assembly comprising:

a sleeve, a blade at least partially enclosed by the sleeve and coupled thereto; and operating the light source while the knife assembly is coupled to the housing;

decoupling the knife assembly from the housing; and operating the light source while the knife assembly is decoupled from the housing.

13. The method of claim 12, wherein:

the user control is configured to translate in response to the first user actuation and configured to translate and pivot in response to the second user actuation; and the method further comprises applying first and second user actuations to the primary and secondary actuation surfaces, respectively, to operate the light source.

14. The method of claim 13, wherein:

the lighting device further comprises a Hall effect control;

the method further comprises operating the Hall effect control to adjust a mode of operation of the light source associated with the user control;

the light source is a first light source; and the lighting device further comprises a second light source.

15. The method of claim 12, further comprising:

translating the user control laterally in response to the first user actuation; and simultaneously pivoting the user control and translating the user control laterally in response to the second user actuation.

16. The method of claim 12, wherein:

the sleeve comprises engagement members;

the housing comprises a slot having sidewalls with grooves defined therein and configured to slidably receive the engagement members; and the decoupling comprises sliding the engagement members along a first direction to decouple the knife assembly in relation to the housing.

17. The method of claim 16, wherein:

the engagement members comprise elongate tongues disposed at least partially about a perimeter of the sleeve; and the grooves comprise elongate voids configured to receive the tongues to prevent translation of the knife assembly in a second direction orthogonal to the first direction.

18. The method of claim 16, wherein:

the sleeve comprises a locking member;

the housing comprises a recess in at least one of the sidewalls of the slot; and the method further comprises receiving the locking member in the recess to secure the sleeve within the slot.

19. The method of claim 12, wherein:

the knife assembly further comprises a user-operable sliding mechanism coupled to the blade; and the method further comprises translating the sliding mechanism relative to the sleeve to selectively extend and retract the blade from the sleeve.

20. The method of claim 19, wherein:

the blade comprises a tab biased in a first direction;

the sleeve comprises a stop configured to engage with the tab while biased in the first direction to prevent the translation of the sliding mechanism; and the method further comprises operating a safety mechanism of the knife assembly to bias the tab in a second direction to disengage the tab from the stop to permit the translation of the sliding mechanism.

21. The method of claim 20, wherein the tab is a first tab, the stop is a first stop, the user-operable safety mechanism is a first user-operable safety mechanism, and wherein:

the blade further comprises a second tab biased in the first direction;

the sleeve further comprises a second stop configured to engage with the second tab while biased in the first direction to prevent the translation of the sliding mechanism;

the knife assembly further comprises a second user-operable safety mechanism configured to bias the second tab in the second direction to disengage the second tab from the second stop to permit the translation of the sliding mechanism; and the method further comprises operating the safety mechanism of the knife assembly to bias the second tab in the second direction to disengage the second tab from the second stop to permit the translation of the sliding mechanism.

22. The method of claim 12, wherein the lighting device further comprises a laser aligned relative to the blade to direct a laser beam toward a work surface.

* * * * *